United States Patent [19]

Fukushima et al.

[11] Patent Number: 4,771,153

[45] Date of Patent: Sep. 13, 1988

[54] APPARATUS FOR MICROWAVE HEATING OF CERAMIC

[75] Inventors: Hideoki Fukushima; Teruo Yamanaka; Masao Matsui, all of Aichi, Japan

[73] Assignee: Kabushiki Kaisha Toyota Cho Kenkyusho, Yokomichi, Japan

[21] Appl. No.: 18,278

[22] Filed: Feb. 24, 1987

[30] Foreign Application Priority Data

Feb. 21, 1986 [JP] Japan ..... 61-37739

[51] Int. Cl.[4] ..... H05B 6/68

[52] U.S. Cl. ..... 219/10.55 B; 219/10.55 A; 264/25

[58] Field of Search ..... 219/10.55 B, 10.55 A, 219/10.55 R, 10.55 F, 10.55 M; 264/25, 26; 333/17 R, 231, 232, 233

[56] References Cited

U.S. PATENT DOCUMENTS

| | | | |
|---|---|---|---|
| 3,461,401 | 8/1969 | Williams | 219/10.55 B X |
| 4,057,702 | 11/1977 | Lacombz-Allard | 219/10.55 A |
| 4,196,332 | 4/1980 | Mackay et al. | 219/10.55 B |
| 4,210,795 | 7/1980 | Lentz | 219/10.55 B |
| 4,314,128 | 2/1982 | Chitre | 219/10.55 B |
| 4,567,340 | 1/1986 | Latchum, Jr. | 219/10.55 A X |
| 4,689,459 | 8/1987 | Gerling | 219/10.55 A |

FOREIGN PATENT DOCUMENTS

| | | |
|---|---|---|
| 0010663 | 5/1980 | European Pat. Off. . |
| 2487623 | 1/1982 | France . |

OTHER PUBLICATIONS

"Microwave Sintering of Ceramics", (Feb. 1984), by Northwestern University.

*Primary Examiner*—Philip H. Leung

*Attorney, Agent, or Firm*—Oblon, Fisher, Spivak, McClelland & Maier

[57] ABSTRACT

An apparatus for heating a ceramic by microwave power. The apparatus has a cavity resonator in which the ceramic is placed. The resonator is provided with a variable iris. The apparatus detects the temperature of the ceramic or other state of the ceramic, and adjusts the area of the opening in the iris in the resonator and the resonant frequency of the resonator according to the signal produced by the detection, in order to bring the resonator substantially into resonance and the degree of coupling to exactly or nearly unity. Alternatively, the apparatus adjusts its microwave power for these purposes. The apparatus can heat the ceramic efficiently at a desired heating rate.

18 Claims, 18 Drawing Sheets

APPARATUS FOR MICROWAVE HEATING OF CERAMIC

BACKGROUND OF THE INVENTION

1. Field of the Invention

The present invention relates to an apparatus for heating ceramics at high temperatures and at a controlled rate by means of microwaves.

2. Description of the Prior Art

Speciality ceramics which are used as structural materials withstanding high temperatures exhibit excellent properties, including heat resistance, anticorrosion, and abrasion resistance. They find extensive application in automobiles, aircrafts, electronic materials, etc. In order to improve the quality, there is a growing tendency toward higher purification and higher density of ceramics. As a result, it has become increasingly difficult to sinter and shape ceramics, which constitutes an impediment to extension of application of ceramics.

In recent years, microwave heating has been proposed to sinter or shape these ceramics. A well known application of microwave heating is domestic microwave oven. Also, microwave heating finds industrial applications, such as vulcanization of rubber, drying of wood and printed matter, and drying and sterilization of food. These materials are easy to heat by means of microwaves, because they have large dielectric loss factors given by $\epsilon_r \tan \delta$. Generally, however, ceramics have small dielectric loss factors and so they are difficult to heat by means of microwave energy.

In an attempt to effectively heat ceramics, a method using a cavity resonator has been proposed. Specifically, a mass of ceramic is inserted in the resonator. Microwave power is caused to enter it so that the resonator may resonate. Thus, the mass is heated. Those which have been heretofore reported to be heated by this method are generally ceramics having dielectric loss factors greater than 1 and ceramics of low purities less than 50%. It has been difficult to heat ceramics having high purities and dielectric loss factors less than 0.1 to high temperatures by this method.

Also, attempts have been made to match a cavity resonator, using an EH tuner or stub tuner. However, it has been impossible to heat ceramics which exhibit small dielectric loss factors at ordinary temperatures up to high temperatures for the following reason. When these ceramics are heated, their dielectric loss factors change rapidly, greatly increasing the power of microwaves reflected from the cavity resonator.

An improved method of heating using a cavity resonator consists in driving a plunger in the resonator. The resonant frequency of the resonator is adjusted by the movement of the plunger, in order to improve the efficiency of heating of ceramic. However, as a ceramic is heated in this way, the reflected power increases rapidly, making it impossible to heat it to high temperatures.

Microwave heating has the advantage that it can heat materials rapidly. However, it is very difficult to control the heating velocity. One conventional method of controlling the heating velocity is to control the power of microwaves and the time for which the microwave is applied. Another conventional method consists in adjusting the power of microwaves according to the heating temperature. Where ceramics whose dielectric loss factors depend strongly on temperature are heated by either method, the dielectric loss factor changes sharply with temperature. Therefore, it has been difficult to regulate the power against temperature variations. Hence, accurate control of temperature has been impossible. Especially, when a ceramic is heated rapidly to a high temperature, a large temperature error results. This means that the material is frequently heated above the intended temperature. As a result, nonuniform heating, or deterioration of characteristics in the material takes place, thus greatly lowering the reliability of the heating.

SUMMARY OF THE INVENTION

It is an object of the present invention to provide an apparatus capable of heating even ceramics of low dielectric loss factors by microwave heating efficiently at high temperatures and at a controlled rate.

A first aspect of the invention resides in an apparatus for microwave heating of a ceramic, the apparatus comprising: a cavity resonator in which the ceramic is placed and heated, the resonator having a variable iris for introducing microwave power; a microwave generator portion for directing microwave power into the resonator; a detector portion for detecting the state of the heated ceramic placed in the resonator; a control portion for producing interrelated signals to adjust the area of the opening of the iris in the resonator and to adjust the resonant frequency of the resonator according to the detected state of the ceramic so that the resonator may substantially resonate and that the degree of coupling may become exactly or nearly unity(critical coupling); an iris control portion for adjusting the area of the opening of the iris in the resonator according to one output signal from the control portion; and a frequency control portion for adjusting the resonant frequency of the resonator according to another output signal from the control portion.

In the first aspect of the invention, the ceramic is heated while the resonator is brought substantially into resonance and the degree of coupling is brought to exactly or nearly unity.

A second aspect of the invention resides in an apparatus for microwave heating of a ceramic, the apparatus comprising: a cavity resonator in which the ceramic is placed and heated, the resonator having a variable iris for introducing microwave power; a microwave generator portion for directing microwave power into the resonator; a detector portion for detecting the power of microwaves entering the resonator, the power of microwaves reflected from the resonator, and the temperature of the ceramic placed in the resonator; a first control portion for producing interrelated signals to adjust the area of the opening of the iris in the resonator and to adjust the resonant frequency of the resonator according to the output signals from the detector portion so that the resonator may substantially resonate and that the degree of coupling mav become exactly or nearly unity; an iris control portion for adjusting the area of the opening of the iris in the resonator according to one output signal from the first control portion; a frequency control portion for adjusting the resonant frequency of the resonator according to another output signal from the first control portion; a second control portion which receives the output signals from the detector portion and delivers a signal for adjusting the microwave power to heat the ceramic at a desired heating rate according to the dielectric loss factor and the thermal loss of the ceramic and the reflection coefficient (=reflected power/incident power) at the detected temperature; and a power control portion for adjusting the power of the microwave generator portion according to the output signal from the second control portion.

The above and other objects, features, and advantages of the present invention will become more apparent from the following description when taken in conjunction with the accompanying drawings in which preferred embodiments of the invention are shown by way of illustrative examples.

BRIEF DESCRIPTION OF THE DRAWINGS

FIGS. 10 to 15 illustrate first to third embodiments according to the first aspect of the invention; wherein FIG. 10 is a block diagram of a first embodiment;

FIG. 11 is a flowchart for illustrating the arithmetic operations performed by the computer shown in FIG. 10;

FIG. 12 is a graph for illustrating the heating performance of the apparatus shown in FIG. 10;

FIG. 13 is a flowchart for illustrating the arithmetic operations performed by the computer included in a second embodiment;

FIG. 14 is a block diagram of a third embodiment;

FIG. 15 is a graph showing the relation of the position of the plunger shown in FIG. 14 to the temperature of the sample, as well as the relation of the width of the iris to the temperature of the sample;

FIGS. 16 to 19 show fourth to seventh embodiments according to the second aspect of the invention; wherein FIG. 16 is a block diagram of these embodiments;

FIG. 17 is a flowchart for illustrating the arithmetic operations performed by the computer shown in FIG. 16;

FIG. 18 is a graph showing the heating performance of the apparatus shown in FIG. 16; and FIG. 19 is a graph in which the dielectric loss factor of the sample shown in FIG. 16 is plotted against the temperature of the sample.

DETAILED DESCRIPTION OF THE INVENTION

Figure 1:
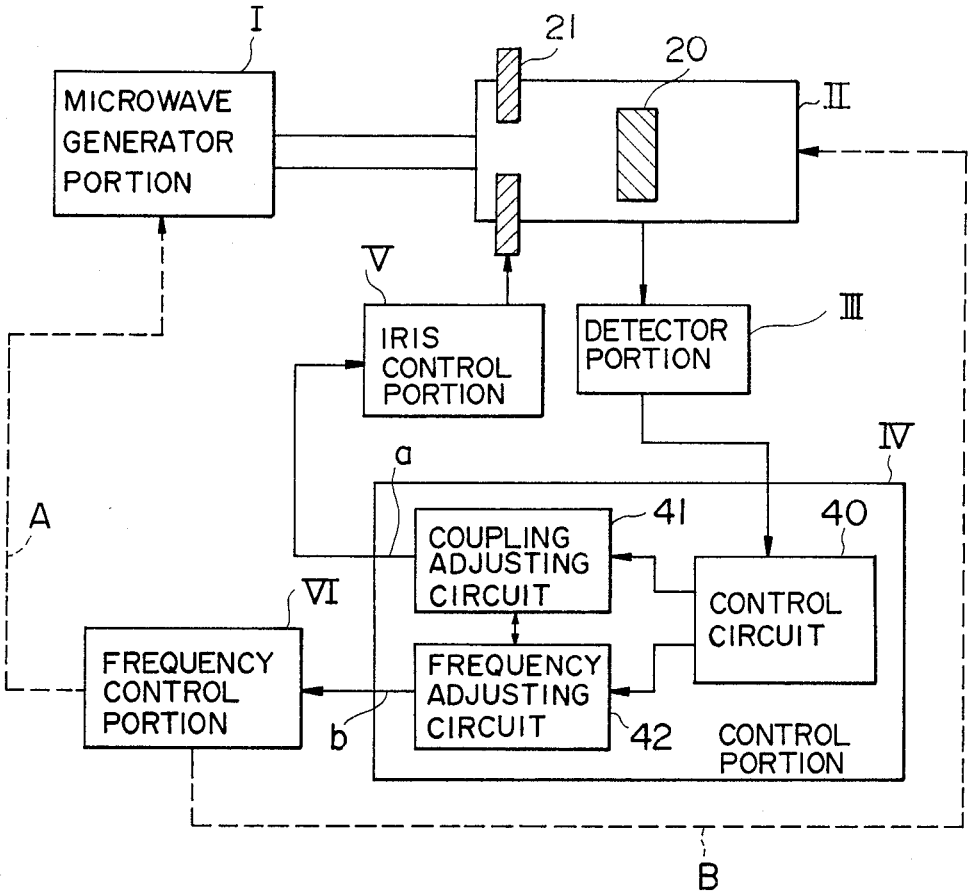
FIG. 1 is a block diagram of an apparatus constituting a first aspect of the invention.

Referring to FIG. 1, there is shown a heating apparatus constituting a first aspect of the present invention. This apparatus comprises a microwave generator portion I, a cavity resonator II, a detector portion III, a control portion IV, an iris control portion V, and a frequency control portion VI. The resonator II is provided with a variable iris 21 so that the microwave power from the microwave generator portion I enter the resonator through the iris 21. A mass of ceramic 20 to be heated is placed inside the resonator H.

In the operation of the apparatus constructed as described above, microwave power enter the cavity resonator to heat the mass of ceramic. As the ceramic is heated, the specific dielectric constant varies even if the resonator resonates and the degree of coupling is equal to 1. Thus, the resonant frequency is shifted. Also, the dielectric loss factor of the ceramic changes, bringing about a change in the degree of coupling. Generally, as speciality ceramics such as alumina, silicon nitride, and silicon carbide, are heated, their specific dielectric constants and dielectric loss factors increase, giving rise to decreases in the resonant frequency and in the degree of coupling of the cavity resonator.

Accordingly, the apparatus constituting the first aspect of the invention further includes a means for adjusting the area of the opening of the variable iris in the cavity resonator to bring the degree of coupling to unity, and a means for adjusting the resonant frequency of the resonator to bring the resonator into resonance. Since the coupling degree and the resonant frequency depend on each other, the signal for adjusting the opening area of the iris and the signal for adjusting the resonant frequency of the resonator are arithmetically treated in an interrelated manner. The adjustments are made according to these signals to maintain the resonator substantially in resonance and to retain the degree of coupling at exactly or nearly 1. In this way, the ceramic is efficiently heated.

In the apparatus shown in FIG. 1, the state of the heated ceramic placed in the resonator II is detected by the detector portion III. The resulting signal is fed to the control portion IV, in which a control circuit 40 supplies signals to a coupling adjusting circuit 41 and to a frequency adjusting circuit 42 to adjust the degree of coupling of the resonator II and the resonant frequency in an interrelated way according to the signal applied from the detector portion III. The adjusting circuit 41 feeds a signal a to the iris control portion V to adjust the opening area of the iris 21 in the resonator II. The frequency adjusting circuit 42 delivers a signal b to the frequency control portion VI to adjust the resonant frequency of the resonator II. Thus, the degree of coupling and the resonant frequency of the resonator II are adjusted.

Figure 2:
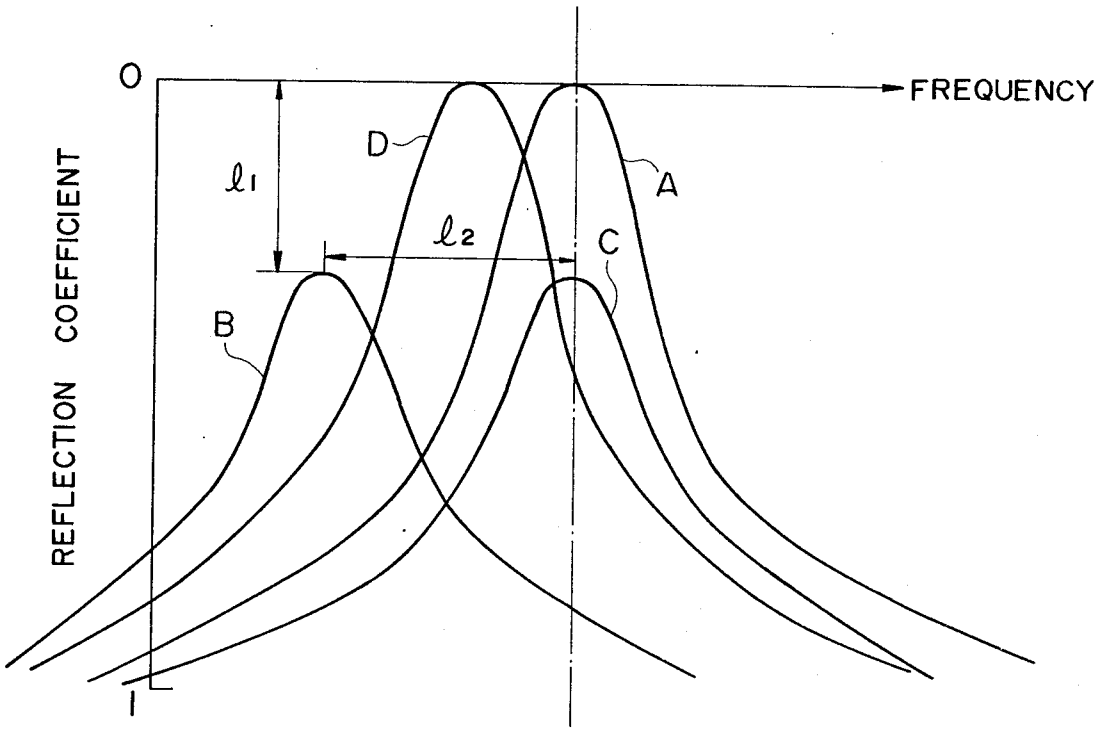
FIG. 2 is a graph, for illustrating the principle on which the apparatus shown in FIG. 1 operates.

The principle on which the apparatus shown in FIG. 1 heats the ceramic is now described by referring to FIG. 2, in which the reflection coefficient of the cavity resonator is graphed against the frequency, the reflection coefficient being given by the reflected power of microwaves divided by the incident power. First, the cavity resonator in which the ceramic is placed resonates, and the degree of coupling is 1, i.e., the reflection coefficient is zero. This condition is indicated by curve A. As the ceramic is heated, the specific dielectric constant and the dielectric loss factor vary, resulting in changes in the degree of coupling and in the resonant frequency. Thus, the characteristic shifts to curve B. Then the resonant frequency of the resonator is made equal to the frequency of the microwave generator portion I by the use of the frequency control portion VI. Under this condition, the characteristic is represented by curve C. However, the mere coincidence between the two frequencies does not immediately bring the coupling degree of the resonator to unity. Therefore, the degree of coupling is made equal to 1 by the iris control portion V which adjusts the opening area of the variable iris in the resonator. In this state, the characteristic is given by curve D. This operation also shifts the resonant frequency and so the frequency is further adjusted so that the two frequencies may coincide. This condition is represented by curve A.

Since a change in the degree of coupling and a change in the resonant frequency affect each other as mentioned above, the operation for adjusting the frequency and the operation for adjusting the opening area of the iris must be performed in an interrelated manner. That is, it is necessary to make one adjustment, taking account of the amount of change made to the other. By performing these two operations, the resonator is brought into resonance, and the degree of coupling is brought to exactly or nearly unity. Consequently, the ceramic can be efficiently heated. These two operations can be performed alternately or simultaneously. More specifically, when they are effected alternately, only the shifts in the degree of coupling and in the resonant frequency are compensated for. When the two operations are carried out concurrently, the shifts in the degree of coupling and in the resonant frequency are theoretically found from the amount of control, in order to make amendments. In a further process, the relation of the amount of change in the reflection coefficient of the resonator caused by a temperature variation of the ceramic to the amount of change in the resonant frequency of the resonator is first found. When the characteristic shifts from curve A to curve B during heating as shown in FIG. 2, the degree of coupling and the resonant frequency are varied, corresponding to the amount of change $l_1$ in the reflection coefficient and the amount of change $l_2$ in the resonant frequency, in accordance with the relation found as described above.

The frequency adjustment is made either by adjusting the frequency of the microwave generator portion I or by adjusting the resonant frequency of the cavity resonator II. In the former case, path A may be adjusted to adjust the frequency of the oscillator. In the latter case, path B may be adjusted to adjust the length of the resonator II.

In the apparatus shown in FIG. 1, the operation for adjusting the degree of coupling of the resonator and the operation for adjusting the resonant frequency of the resonator can be performed in an interrelated manner. The degree of coupling is adjusted by varying the opening area of the iris. Therefore, the resonator is kept substantially in resonance, and the degree of coupling is maintained at exactly or nearly 1. Hence, the apparatus is able to rapidly heat the ceramic to a high temperature, because it can heat it efficiently. Since the apparatus heats ceramics in the best conditions as described above, it can heat ceramics having dielectric loss factors less than 0.01. The novel apparatus described thus far can take various forms in the manner described below.

The first aspect of the invention may have the following modes.

Figure 3:
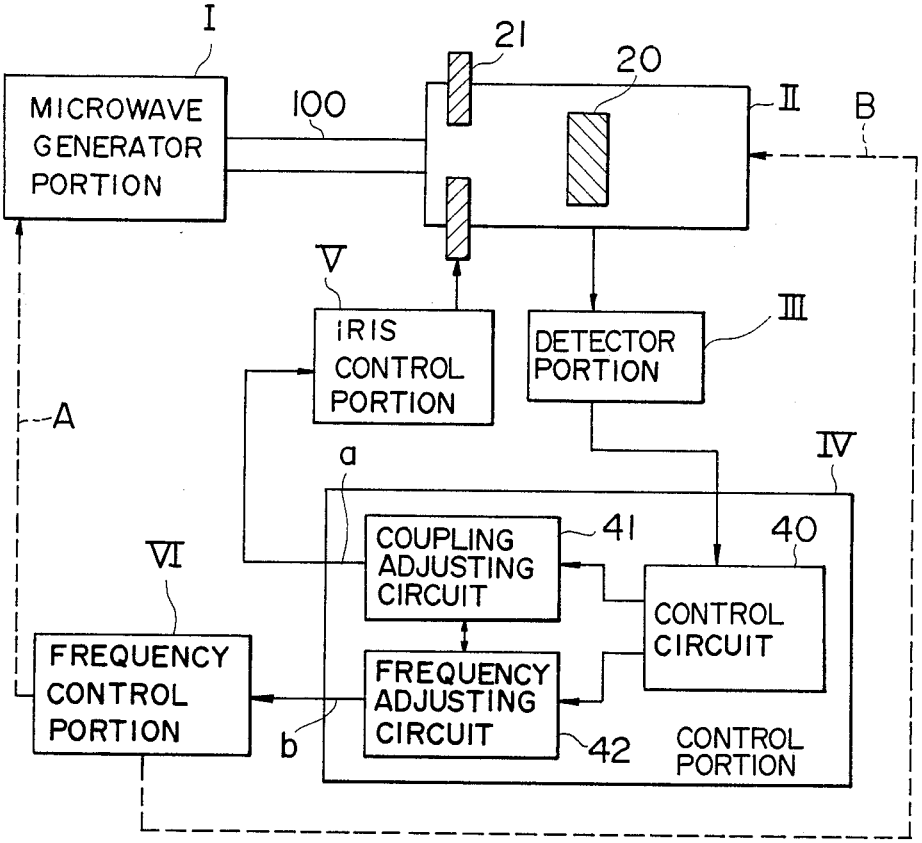
FIGS. 3–8 are block diagrams of specific modes of the first aspect of the invention.

According to the first mode of the first aspect of the invention as shown in FIG. 3, the control portion IV comprises a controller for generating interrelated signals of the resonant frequency of the resonator and the opening area of the iris which are decided by the heating state of the ceramic and mutual variation of the resonant frequency and the degree of coupling in controlling the resonant frequency and the opening area of the iris, in order to cause the resonator to substantially resonate and the degree of coupling of the resonator to become exactly or nearly unity.

According to the second mode of the apparatus shown in FIG. 3, the control portion IValternately delivers two signals one of which is used to vary the opening area of the iris of the resonator, the other being employed to adjust the resonant frequency. The control portion IV delivers two signals a and b to bring the resonator substantially into resonance and make the degree of coupling equal to exactly or nearly 1. The cavity resonator II has the variable iris 21 for introducing microwave power. The mass of ceramic 20 is placed in the resonator II which is connected with the microwave generator portion I by a waveguide 100. It is also possible to use a coaxial cable instead of the waveguide. The microwave power generated from the microwave generator portion I pass through the waveguide 100 and enter the resonator II, where the microwave power heats the ceramic 20. The temperature of the ceramic 20 inside the resonator II is detected by the detector portion III. The resulting signal is fed to the control portion IV.

In response to the signal applied from the detector portion III, the control portion IV delivers the two interrelated signals a and b to the iris control portion V and the frequency-adjusting portion VI, respectively. The signal a applied to the windowadjusting portion V is used to adjust the opening area of the iris 21, and the signal b furnished to the frequency control portion VI acts to adjust the resonant frequency of the resonator II for bringing the resonator II substantially into resonance and the degree of coupling to exactly or nearly unity. In this mode , these two signals a and b are delivered alternately. The signal b for adjusting the frequency is fed to the frequency control portion VI to bring the resonator II into resonance. However, the degree of coupling is not always equal to unity even if the resonator II resonates. Therefore, the signal a for adjusting the iris is then delivered to the iris control portion V. Thus, the opening area of the iris is varied to bring the degree of coupling to unity, which in turn shifts the resonant frequency. Accordingly, the aforementioned adjustment to the frequency is made. These operations are repeated.

By delivering the signals a and b alternately, the resonator II is brought substantially into resonance, and the degree of coupling is made equal to exactly or nearly unity. In this way, the ceramic can be heated efficiently.

The condition of the heated ceramic 20 that is detected by the detector portion III is either the temperature of the ceramic or the power of microwaves entering the resonator and reflected from it. If both are detected, the resonator II can be brought into the above-described condition more accurately.

Figure 4:
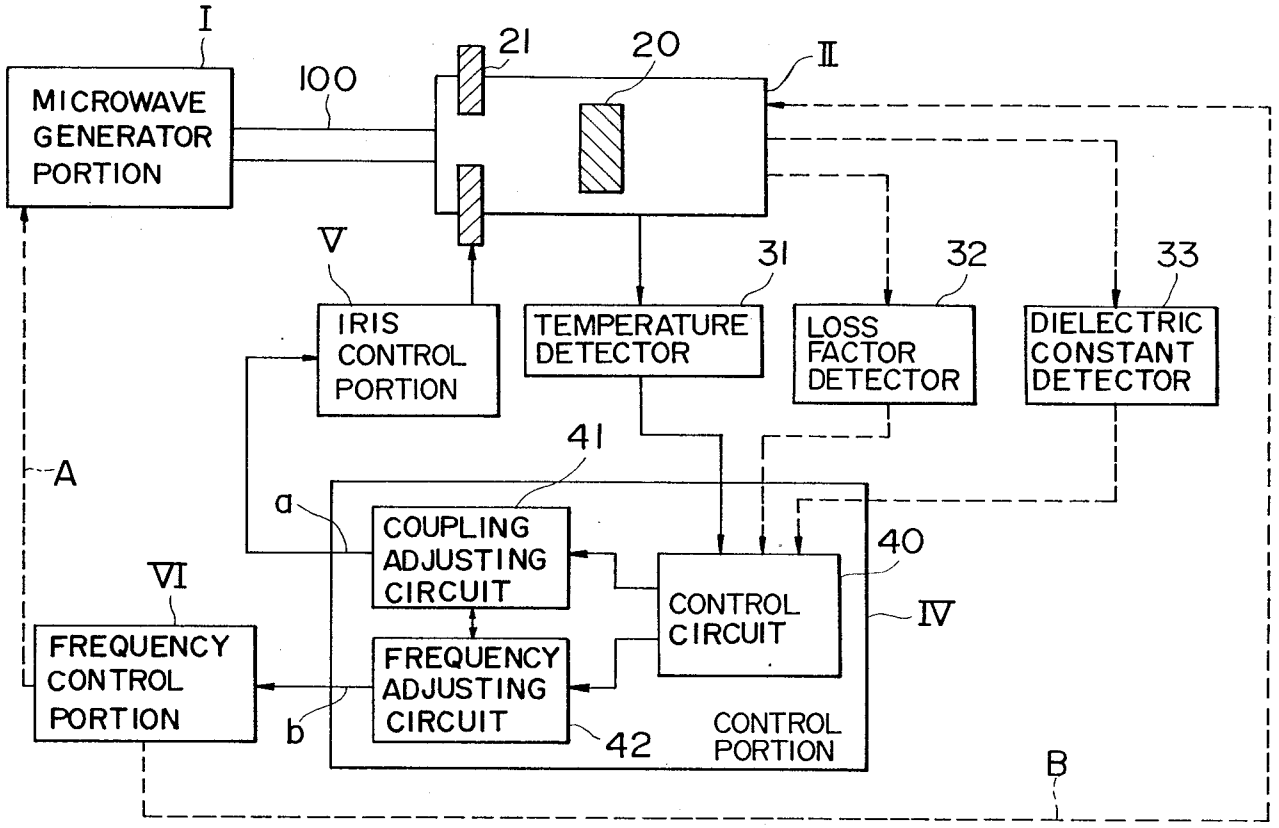

A third mode of the first aspect of the invention is shown in FIG. 4, where the detector portion detects the temperature of the ceramic placed inside the cavity resonator. The control portion delivers the signal a for adjusting the opening area of the variable iris in the resonator according to the dielectric loss factor of the ceramic at the detected temperature. The control portion also delivers the signal b for adjusting the resonant frequency of the resonator according to the specific dielectric constant of the ceramic at the detected temperature.

More specifically, in the same manner as in the first and second modes shown in FIG. 3, microwave power is caused to enter the cavity resonator II to heat the ceramic 20 placed in the resonator. The temperature of the ceramic 20 is detected by a temperature detector 31 whose output signal is fed to the control portion IV. The dielectric loss factor and the specific dielectric constant are obtained from the control portion IV at every temperature. As an example, the values of the loss factor and the dielectric constant are determined prior to the heating, and the data is stored in the control portion IV. Alternatively, the control portion may receive a signal indicating the dielectric loss factor of the ceramic 20 from a dielectric loss factor detector 32 and a signal indicating the specific dielectric constant from a specific dielectric constant detector 33 at every temperature during the heating. Therefore, the control portion IV can know the dielectric loss factor and the specific dielectric constant of the ceramic while it is being heated. When the degree of coupling is equal to unity, a certain relation exists between the dielectric loss factor and the opening area of the iris Thus, after determining the dielectric loss factor, the control portion IV delivers the signal a to the iris control portion V so that the opening area may become the value determined by the above-described relation under the condition that the degree of coupling is 1. Also, a certain relationship exists between the specific dielectric constant and the resonant frequency of the resonator. After determining the specific dielectric constant, the control portion IV delivers the signal b to the frequency control portion VI so that the resonant frequency of the resonator may coincide with the frequency of the oscillator according to the above-described relationship, i.e., the resonator resonates. This is described in greater detail below.

Generally, the perturbation theory gives the relation $$1/Q_d = 2k\ \epsilon_r \tan\delta(\Delta V/V) \quad (1)$$

where $Q_d$ is Q due to the loss caused by the insertion of a ceramic, k is the shape coefficient, $\epsilon_r \tan\delta$ is the dielectric loss factor of the ceramic, $\epsilon_r$ is the specific dielectric constant, $\tan\delta$ is the dielectric loss tangent, V is the volume of the cavity resonator, and $\Delta V$ is the volume of the ceramic. Under this condition, when the degree of coupling is 1, a certain relation exists between the opening area of the iris and $Q_d$. As this area increases, $Q_d$ decreases. Thus, it is possible to determine the opening area of the iris when the degree of coupling is 1 by finding the value of the dielectric loss factor $\epsilon_r \tan\delta$.

Similarly, with respect to adjustments of the frequency, the following relationship holds:

$$\Delta f/f_0 = k\ (\epsilon_r - 1)\ (\Delta V/V) \quad (2)$$

where $f_0$ is the resonant frequency and $\Delta f$ is the amount of the change in the resonant frequency. Therefore, the resonant frequency of the resonator can be determined by finding the value of the specific dielectric constant $\epsilon_r$.

Also in this mode, the change in the degree of coupling and the change in the resonant frequency affect each other. The signal a for adjusting the iris and the signal b for adjusting the frequency are interrelated with each other. When both the dielectric loss factor and the specific dielectric constant are detected during the heating of the ceramic, it is not necessary to detect the temperature of the ceramic. In this way, the cavity resonator II is maintained substantially in resonance. Also, the degree of coupling can be made equal to exactly or nearly 1.

Figure 5:
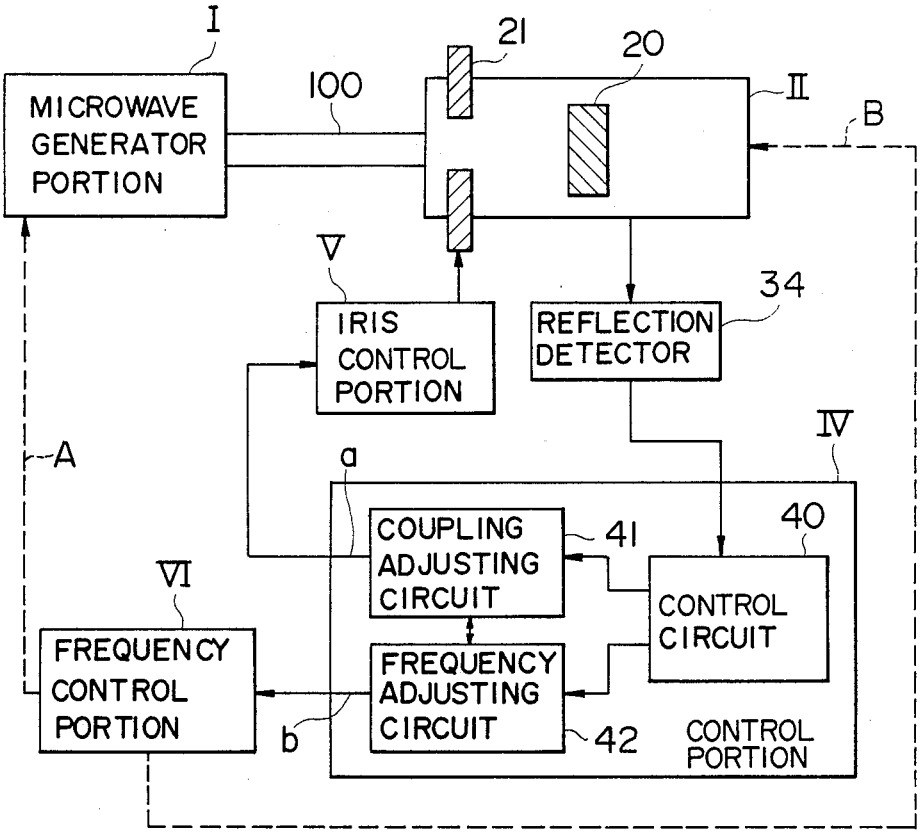

Referring next to FIG. 5, there is shown a fourth mode of the first aspect of the invention. The detector portion detects the power of microwaves entering the cavity resonator and the power of reflected microwaves. More specifically, in the same manner as the first and second modes, the microwave power enters the cavity resonator II. The power of the microwaves entering the resonator and the power of the reflected microwaves are detected by a reflection detector 34. The reflection coefficient that is the reflected power divided by the incident power is found. The resulting signal is fed to the control portion IV, which supplies the signal a for adjusting the iris to the iris control portion V and the signal b for adjusting the resonant frequency to the frequency control portion VI, in order to reduce the measured reflection coefficient. The signals a and b are interrelated with each other. As the reflection coefficient decreases, the degree of coupling of the resonator II approaches 1, and the resonator substantially resonates.

Figure 6:
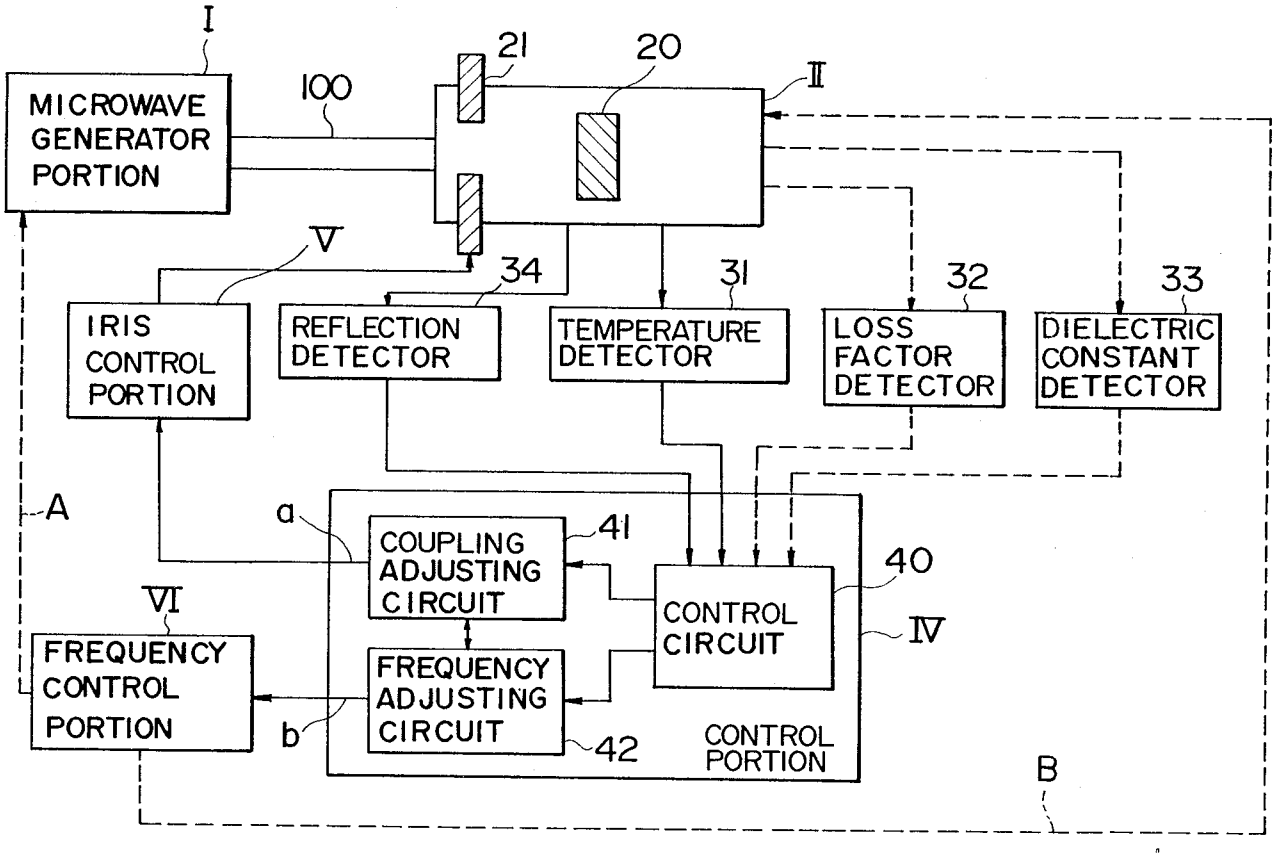

Referring to FIG. 6, there is shown a fifth mode of the first aspect of the invention. The detector portion consists of a means for detecting the power of microwaves entering the cavity resonator and the reflected power and a means for detecting the temperature of the ceramic inside the resonator. More specifically, in the same manner as the first and second modes shown in FIG. 3, microwave power enters the resonator II. The incident power and the reflected power are detected by a reflection detector 34. The temperature of the ceramic 20 placed inside the resonator II is detected by a temperature detector 31. The resulting signals are applied to the control portion IV which finds the dielectric loss factor and the specific dielectric constant of the ceramic 20 at every temperature, in the same way as in the third mode shown in FIG. 4. The control portion IV supplies interrelated signals a and b to the iris control portion V and the frequency control portion VI, respectively, according to the dielectric loss factor and the specific dielectric constant of the ceramic at every temperature, in order to reduce the detected reflection coefficient. In this mode, fundamental control operations are performed according to the relation between the temperature and the dielectric loss factor and the specific dielectric constant. Since accurate control operations are carried out in response to the detection of the reflection coefficient, this apparatus is capable of bringing the resonator II substantially into resonance and the degree of coupling to exactly or nearly 1 more rapidly and more accurately than the third and fourth modes.

Figure 7:
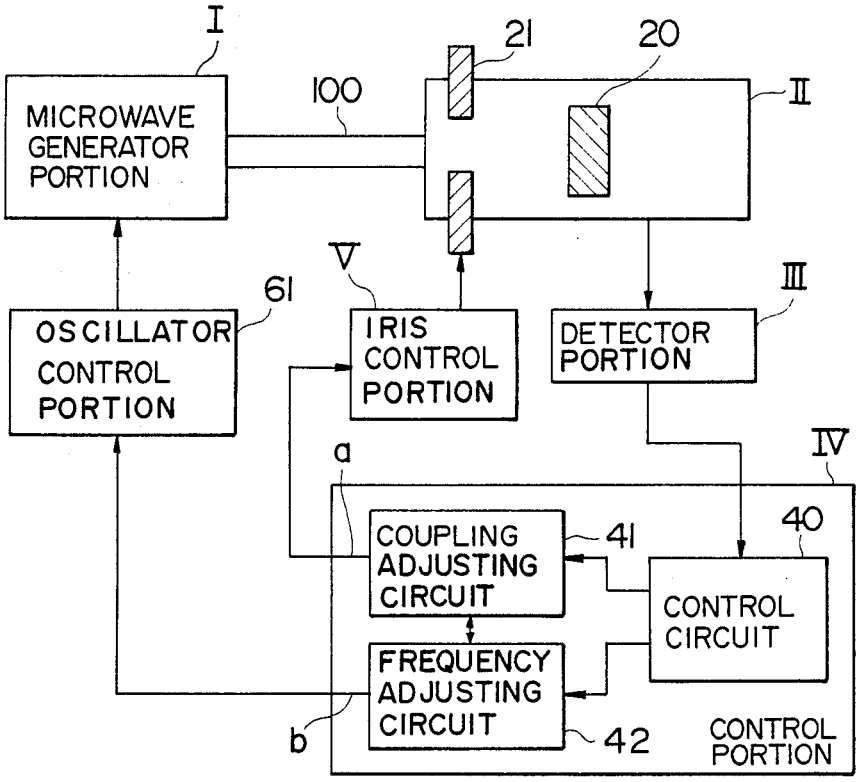

Referring next to FIG. 7, there is shown a sixth mode of the first aspect of the invention. The frequency control portion adjusts the frequency of the microwave generator portion, the generated microwave power being supplied to the cavity resonator. More specifically, in the same way as in the first and second modes shown in FIG. 3, microwave power is supplied into the resonator II to heat the ceramic 20 placed within the resonator. The condition of the heated ceramic 20 is detected by the detector portion III. The resultant signal is fed to the control portion IV. In response to the signal supplied from the detector portion III, the control portion IV applies interrelated signals a and b to the iris control portion V and an oscillator control portion 61, respectively, in order to bring the resonator II substantially into resonance and the degree of coupling to exactly or nearly 1. The oscillator control portion 61 adjusts the frequency of the microwave generator portion I so that the frequency of the oscillator may coincide with the resonant frequency of the resonator II.

Figure 8:
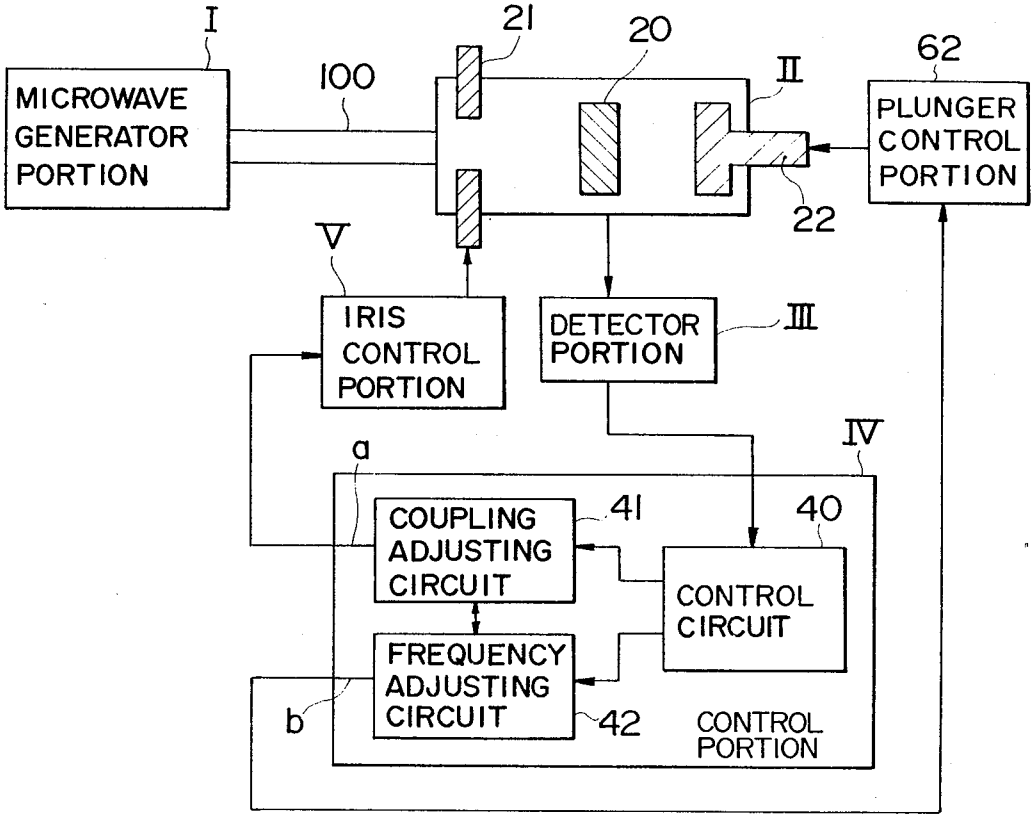

Referring to FIG. 8, there is shown a seventh mode of the first aspect of the invention. The frequency control portion adjusts the length of the resonator. More specifically, a plunger control portion 62 is used instead of the oscillator control portion 61 of the fifth example. A plunger 22 is mounted in the resonator II. The control portion IV delivers the signal b to the plunger control portion 62 to adjust the resonant frequency. The plunger 22 is actuated in response to the output signal from the plunger control portion 62 to adjust the length of the resonator II. This changes the resonant frequency. In this way, the resonant frequency of the resonator II is made equal to the frequency of the oscillator by the action of the plunger 22. The iris control portion V brings the degree of coupling of the resonator II to exactly or nearly unity.

The principle on which another apparatus for heating ceramics is now described. This apparatus constitutes a second aspect of the invention, and brings the cavity resonator substantially into resonance and the degree of coupling to exactly or nearly unity, in the same manner as the apparatus already described in connection with the first aspect. Further, this apparatus heats a ceramic at a desired heating rate according to the dielectric loss factor and the thermal loss of the ceramic that are dependent on the heating temperature, and also according to the reflection coefficient.

In the same manner as the apparatus shown in the first aspect, the opening area of the iris in the cavity resonator and the resonant frequency of the resonator are adjusted in an interrelated manner in order to bring the resonator substantially into resonance and the degree of coupling to exactly or nearly unity. In addition, the ceramic is heated at a desired heating velocity by adjusting the power of microwave generator portion according to the dielectric loss factor, the thermal loss of the ceramic, and the reflection coefficient (=the reflected power divided by the incident power) which depend on temperature.

The dependence of the dielectric loss factor of the ceramic on temperature may be measured during or prior to the heating. Where the dielectric loss factor is measured during the heating, the frequency of the oscillator is swept at every temperature. Under the condition of resonance of the resonator, i.e., the frequency of the oscillator coincides with the resonant frequency, the half-value width is measured as the width of the frequency when the reflection coefficient reaches an intermediate value between 1 and the minimum value by the ordinary method of measuring Q factor, in order to find the dielectric loss factor. To measure the thermal loss, the temperature distribution of the ceramic is first measured. Then, the temperature of the ceramic is measured during the heating to find the thermal loss.

Figure 9:
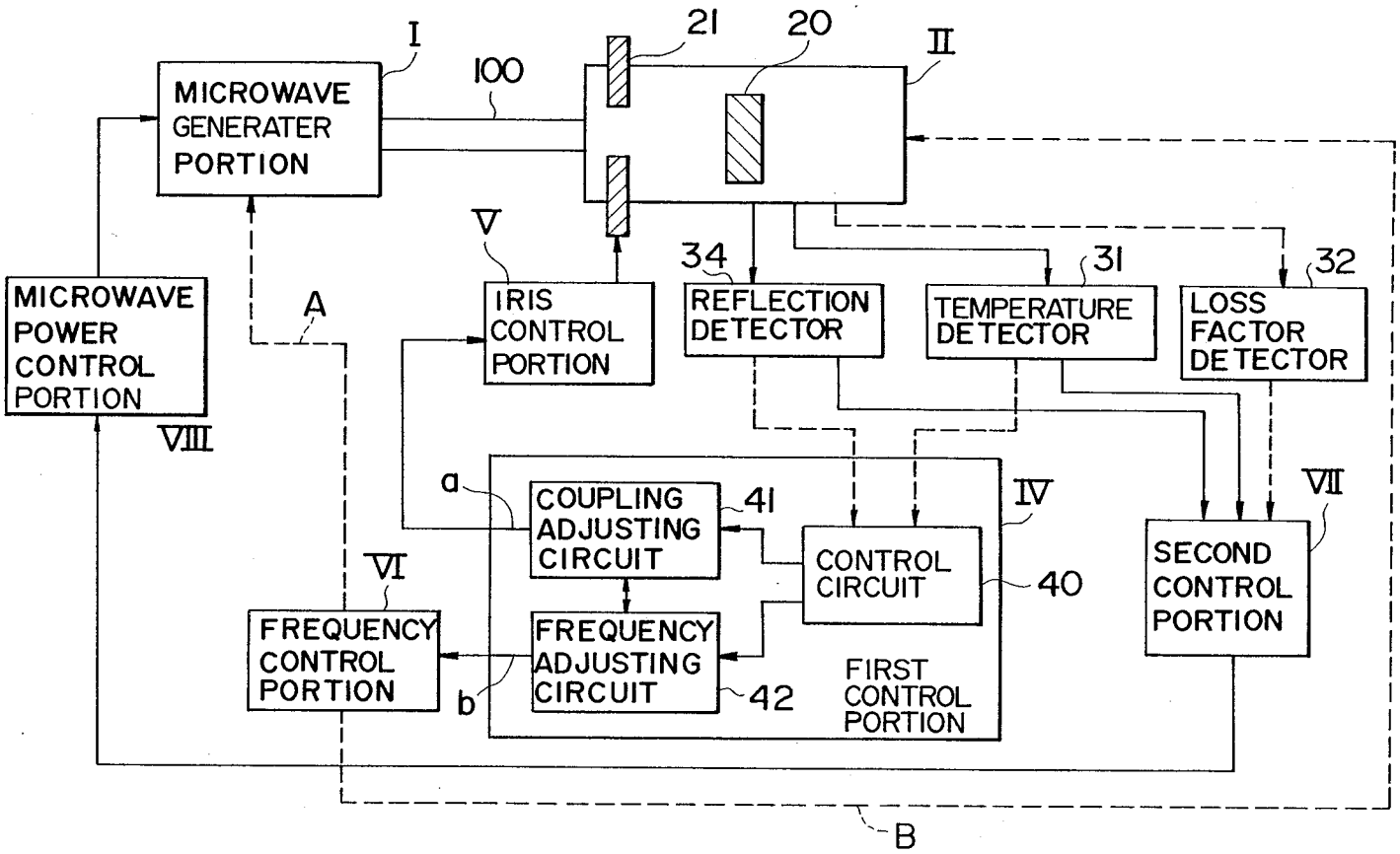
FIG. 9 is a block diagram of an apparatus constituting a second aspect of the invention.

Referring next to FIG. 9, there is shown a heating apparatus that embodies the second aspect of the invention. Specifically, in the same manner as in the apparatus shown in FIG. 3, the microwave power generated by the microwave generator portion I is caused to enter the cavity resonator II . The power of microwaves entering the resonator and the reflected power are detected by a reflection detector 34. The temperature of the ceramic 20 placed in the resonator is detected by a temperature detector 31. All or some of the information regarding the state of the heated ceramic, including the incident power, the reflected power, and the temperature, is fed to a first control portion IV. The control portion IV delivers interrelated signals a and b to the iris control portion V and the frequency control portion VI, respectively. The signal a is used to adjust the opening area of the iris. The signal b is employed to adjust the resonant frequency. In this way, the resonator II is brought substantially into resonance, and the degree of coupling is brought to exactly or nearly 1. The output signal from the temperature detector 31 is furnished to a second control portion VII. The data concerning the dependence of the thermal loss of the ceramic on temperature is stored in the control portion VII. The data concerning the dependence of the dielectric loss factor of the ceramic on temperature is preliminarily stored in the control portion VII. Alternatively, a dielectric loss factor detector 32 detects the loss factor during the heating, arithmetically finds the dependence of the factor on temperature, and feeds the obtained data to the second control portion VII. The second control portion VII also receives the output signal from the reflection detector 34. The second control portion delivers a signal to a microwave power control portion VIII to adjust the power of the microwave generator portion according to the dependence of the dielectric loss factor of the ceramic 20 on temperature, the dependence of the thermal loss on temperature, and the reflection coefficient, for producing a desired heating velocity.

Generally, the amount of heat produced by a ceramic due to dielectric loss is given by $$q_1=(\tfrac{1}{2})\epsilon_0\epsilon_r \tan\delta\ \omega\ E^2\Delta V\ [W] \tag{3}$$

where $\epsilon_0$ is the permittivity of vacuum, $\epsilon_r \tan\delta$ is the dielectric loss factor, $\omega$ is the angular frequency, E is the electric field intensity, and $\Delta V$ is the volume of the ceramic.

Where a cavity resonator is used to heat a ceramic, the formula (3) is modified as follows:

$$q_1 = P(1-R)\frac{Q_u}{Q_u+Q_d}\ [W] \tag{4}$$

where P is the power of the microwave generator portion, R is the reflection coefficient, and $Q_u$ is the Q of the cavity resonator when it is unloaded. From the formula of heat transfer, the relation of the amount of heat $q_1$ generated by the ceramic to the amount of heat q stored in the ceramic is given by $$q=0.86q_1-q_2\ [\text{Kcal/hr}] \tag{5}$$

where $q_2$ is the thermal loss of the ceramic because of the radiation and conduction from the ceramic and the natural convection in the resonator.

Assuming that a time t is taken to heat the ceramic from temperature $T_1$ to $T_2$, the amount of heat is given by $$q=\Delta V\gamma C_p(\Delta T/t)\ [\text{Kcal/hr}] \tag{6}$$

where $\gamma$ is the specific weight, $C_p$ is the specific heat, and $\Delta T$ is the difference between the temperatures $t_2$ and $t_1$. From equations (1), (4)–(6), the power of the microwave generator portion is represented by $$P = \frac{1}{0.86(1-R)}\left\{\Delta V\gamma C_p\frac{\Delta T}{t}+q_2\right\}\left\{1+\frac{V}{2k\epsilon_r\tan\delta Q_u\Delta V}\right\}[W] \tag{7}$$

That is, the relation of the power of microwaves P to the heating velocity $\Delta T/t$ can be found if the dependence of the thermal loss $q_2$ and the dielectric loss factor $\epsilon_r\tan\delta$ on temperature, and the reflection coefficient R at that time are known. The dependence of the dielectric loss factor on temperature can be found by sweeping the frequency, measuring the half-value width, finding $Q_d$, and using equation (1). Consequently, the heating velocity is made equal to a desired value by adjusting the power of microwaves according to the detected reflection coefficient, the thermal loss, and the dielectric loss factor. In this way, the cavity resonator II is brought substantially into resonance and the degree of coupling to exactly or nearly unity. Further, the ceramic can be heated at a desired heating rate. In this aspect, the frequency of the microwaves generated by the microwave generator portion I may be adjusted on the path A shown in FIG. 9, or the length of the resonator II may be adjusted on the path B.

The apparatus shown in FIG. 9 yields the same advantages as the apparatus already described in conjunction with the first aspect. Additionally, it can heat a ceramic at a desired heating velocity by adjusting the power of microwaves according to the changes in the thermal loss, the dielectric loss factor, and the reflection coefficient during the heating. Hence, this apparatus is able to heat a ceramic up to a high temperature stably, accurately, and quite reliably.

Embodiments according to the present invention will be described below.

Figure 10:
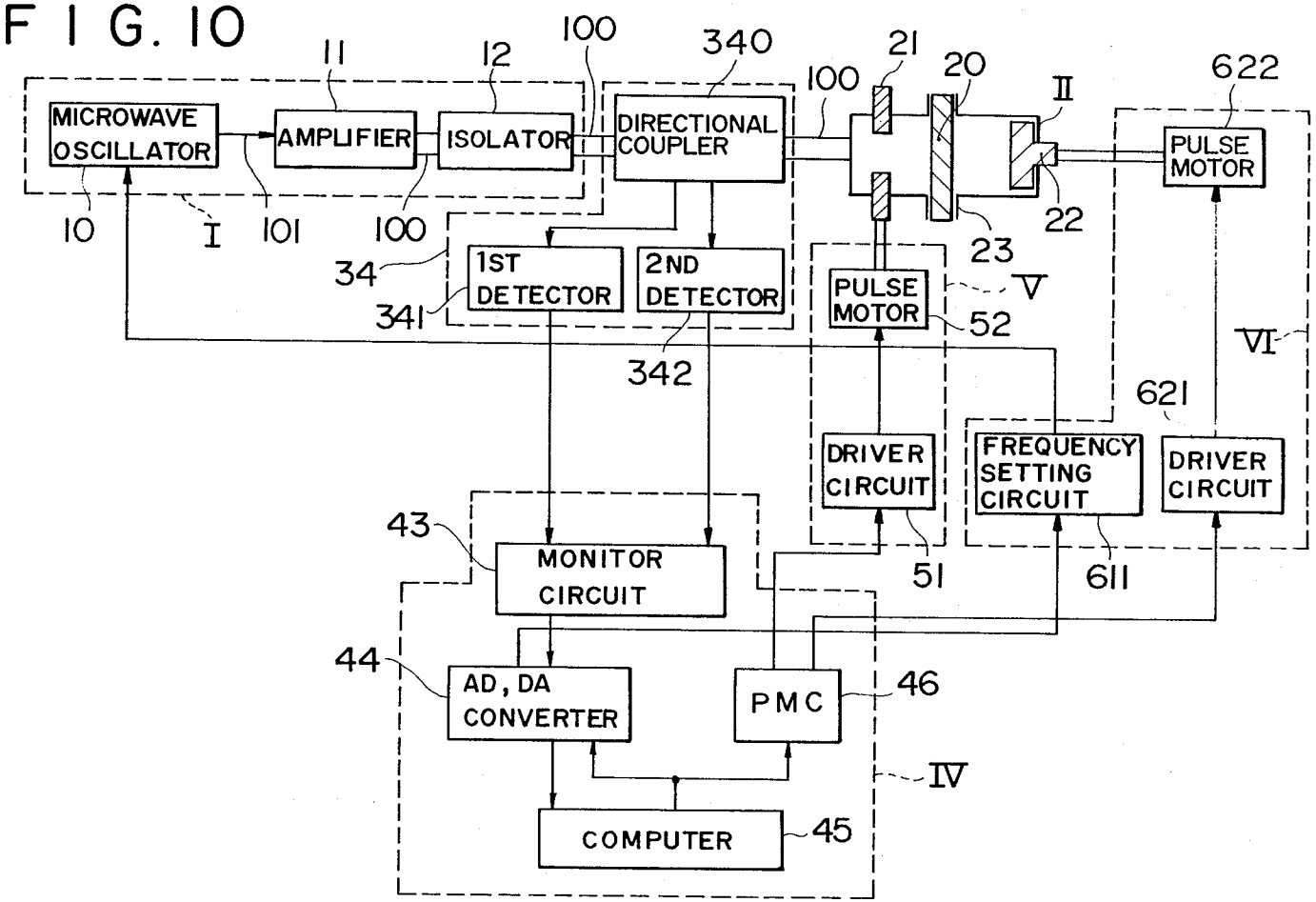

Referring to FIG. 10, there is shown a first embodiment of the apparatus shown in FIG. 1. According to the first embodiment, the microwave power entering a cavity resonator and the reflected power are detected. In response to the resultant signal, the iris in the resonator and the length of the resonator are adjusted to bring the resonator substantially into resonance and the degree of coupling to exactly or nearly unity (critical coupling). This first embodiment belongs to the first, second and fourth modes of the first aspect of the invention.

Specifically, the apparatus shown in FIG. 10 comprises the microwave generator portion I for producing microwave power, the cavity resonator II for heating a sample, the reflection detector 34 for detecting the power entering the resonator and the reflected power, the control portion IV for delivering signals to adjust the degree of coupling of the resonator II and the resonant frequency according to the output signals from the reflection detector 34, the iris control portion V for adjusting the opening area of the variable iris in the resonator to adjust the degree of coupling according to one output signal from the control portion IV, and the frequency control portion VI for adjusting the resonant frequency of the resonator according to another output signal from the control portion IV. The variable iris is used to admit microwave power.

The microwave generator portion I consists of a microwave oscillator 10, an amplifier 11, and an isolator 12 for absorbing the power reflected from the resonator II. The amplifier 11 is connected to the oscillator 10 by a coaxial cable 101. The isolator 12 is connected to the amplifier 11 via a waveguide 100. The frequency of the oscillator 10 is 6 GHz.

The cavity resonator II comprises the variable iris 21 for admitting microwave power, a plunger 22 for varying the length of the resonator II to adjust the resonant frequency of the resonator II, and a sample insertion port 23 through which a sample is inserted. The iris 21 is also used to adjust the degree of coupling.

The reflection detector 34 comprises a directional coupler 340 for separating the power of microwaves entering the resonator II from the reflected power, a first detector 341 for converting the incident power into a low-frequency signal, and a second detector 342 for converting the reflected power into a low-frequency signal. The coupler 340 is located between the isolator 12 and the resonator II. The detectors 341 and 342 are located between the coupler 340 and a detector output monitor circuit 43 (described later).

The control portion IV comprises the aforementioned detector output monitor circuit 43 for detecting the low-frequency signals delivered from the detectors 341, 342, a computer 45 for processing the output signal from the monitor circuit 43, performing arithmetic operations, and issuing instruction signals, an AD,DA converter 44 for converting the signals transmitted between the monitor circuit 43, a frequency setting circuit 611 incorporated in the frequency control portion VI and the computer 45 into suitable form, and a pulse motor controller (PMC) 46. The computer 45 is programmed in the manner described later to control the heating of the ceramic.

The iris control portion V comprises a pulse motor 52 for varying the opening area of the iris 21 in the resonator II and an iris motor driver circuit 51 for driving the pulse motor 52 according to the signal from the control portion IV.

The frequency control portion VI comprises a pulse motor 622 for driving the plunger 22 in the resonator II, a plunger motor driver circuit 621 for driving the pulse motor 622 according to the signal supplied from the control portion IV, and the aforementioned frequency-setting circuit 611 for sweeping the frequency of the microwave oscillator 10 according to the signal supplied from the control portion IV.

Figure 11:
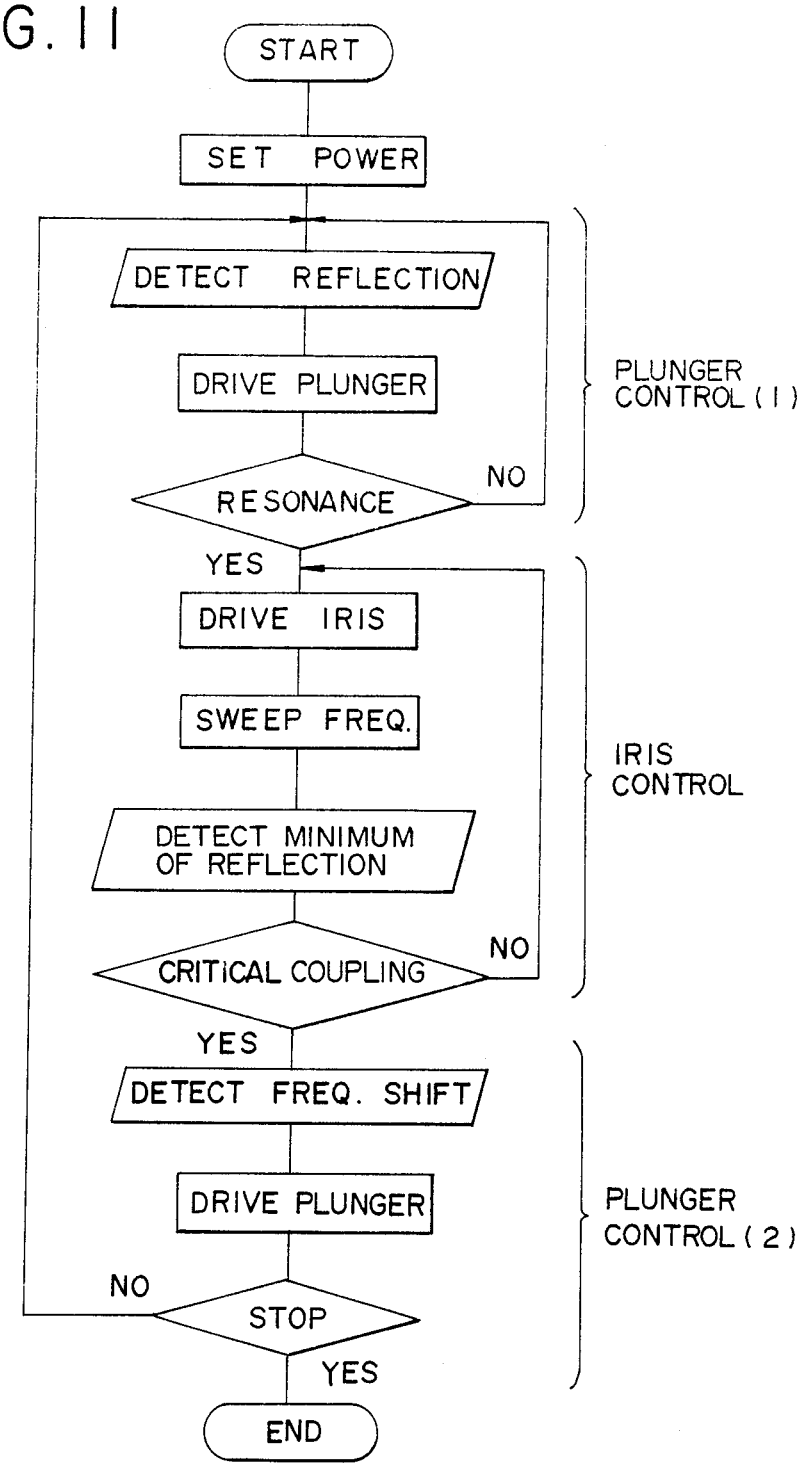

FIG. 11 is a flowchart for illustrating the program inserted in the computer 45. The iris 21 and the plunger 22 in the cavity resonator II are controlled according to this program. First, certain microwave power is produced to heat the ceramic 20 in the resonator II. Since the specific dielectric constant and the dielectric loss factor of the ceramic change by heating, the resonant frequency and the degree of coupling of the resonator II vary. This change in the resonant frequency is compensated for by the plunger control (1) so that the resonant frequency may coincide with the frequency of the oscillator. Thus, the resonator II is brought substantially into resonance. At this time, the degree of coupling of the resonator II is not equal to 1, although the resonator resonates. Then, the iris is controlled to bring the degree of coupling to unity. Under this condition, the power of reflected microwaves is zero, while the incident power is 100%. Therefore, the microwave power is fully admitted into the resonator II. However, this iris control shifts the resonant frequency. Then, the plunger is controlled (2) to detect the amount of the change in the resonant frequency caused by the adjustment of the iris. The resonator II is again brought into resonance. This series of operations beginning with the plunger control (1) and ending with the plunger control (2) is repeated to bring the resonator II substantially into resonance and the degree of coupling to exactly or nearly unity. Consequently, the ceramic 20 can be efficiently heated.

In the aforementioned plunger control (1), the reflection coefficient, i.e., the reflected power divided by the incident power, is detected. Then, the plunger is caused to move a preset distance to reduce the reflection coefficient. More specifically, the reflection coefficient obtained after the movement of the plunger is compared with the reflection coefficient obtained before the movement of the plunger. When the reflection coefficient has decreased after the movement, the plunger is again caused to move the preset distance in the same direction. On the other hand, when the reflection coefficient has increased after the movement, the plunger is caused to move the preset distance in the reverse direction. In this way, the plunger is moved in a stepwise fashion to minimize the reflection coefficient. Thus, the resonant frequency of the resonator II coincides with the frequency of the oscillator, and the resonator II comes into resonance.

The aforementioned iris control is initiated by causing the iris 21 in the resonator II to move a preset distance in a certain direction, for varying the opening area of the iris 21. Then, the frequency of the microwave oscillator 10 is swept to detect the minimum value of the reflection coefficient at that time. The minimum value of the reflection coefficient obtained after the movement of the iris is compared with the minimum value of the coefficient obtained before the movement. When the value has decreased after the movement, the iris is again caused to move the preset distance in the same direction. Inversely, when the minimum value of the coefficient has increased after the movement, the iris is caused to move the preset distance in the reverse direction. In this way, the iris is shifted in a stepwise manner until the minimum value of the reflection coefficient decreases below a certain threshold value. Thus, the degree of coupling of the resonator approaches unity.

The aforementioned iris control gives rise to a shift in the resonant frequency of the resonator II. This shift is compensated for by the plunger control (2). Specifically, when the frequency of the microwave oscillator 10 is swept during the iris control, the amount of change in the resonant frequency is detected. Then, the plunger is caused to move a distance corresponding to the amount of change in the frequency. A certain relation exists between this amount of change in the frequency and the distance traveled by the plunger. The plunger is moved according to this relation to bring the resonator II into resonance. These operations are repeated until certain predetermined conditions, including temperature and time, are reached.

The plunger control (2) may use the same steps as the plunger control (1). It is also possible to omit the plunger control (2) and to alternately repeat the plunger control (1) and the iris control, but the use of the plunger control (2) allows one to narrow the range over which the frequency is swept during the iris control. Further, a stable control operation can be performed, because the reflection coefficient of the resonator changes less.

In the operation of the apparatus shown in FIG. 10, the microwave oscillator 10 produces microwave power which is amplified by the amplifier 11. The amplified microwave power is fed to the cavity resonator II via the isolator 12 and the directional coupler 340. The isolator 12 absorbs the power reflected from the resonator II to protect the amplifier 11. The power of microwaves entering the resonator II is partially separated from the reflected power by the directional coupler 340. The incident power and the reflected power are converted into their corresponding low-frequency signals by the first detector 341 and the second detector 342, respectively. The output signals from these detectors 341 and 342 are fed to the detector output monitor circuit 43.

The output signal from the monitor circuit 43 is fed via the AD,DA converter 44 to the computer 45, which performs arithmetic operations and control operations. The output signals from the computer 45 are fed to the iris motor driver circuit 51 and the plunger motor driver circuit 621 via the pulse motor controller 46. The iris motor driver circuit 51 converts its input signal into a signal for adjusting the iris. The output signal from the driver circuit 51 is applied to the pulse motor 52 to drive the iris 21. Meanwhile, the plunger motor driver circuit 621 converts its input signal into a signal for adjusting the plunger. The output signal from the driver circuit 621 is supplied to the pulse motor 622 to drive the plunger 22. Also, the computer 45 supplies another signal to the frequency setting circuit 611 via the AD,DA converter 44. The setting circuit 611 produces a signal for controlling the resonant frequency. This signal is fed to the microwave oscillator 10 to sweep the frequency.

Experiments were made using the apparatus shown in FIG. 10 to measure the dependence of the reflection coefficient of the cavity resonator II on the temperature of a ceramic, as well as the dependence of the power efficiency, i.e., the ratio of the electric power consumed by the ceramic to the applied microwave power, on the temperature of the ceramic. More specifically, the ceramic was made of a rod of alumina having a diameter of 3 mm and a purity of 99%. The loss factor $\epsilon_r \tan \delta$ of the ceramic was 0.001 at room temperature. The ceramic was inserted in the cavity II through the port 23, and microwave power of about 100 W was applied. The frequency of the microwave oscillator was swept over a frequency range of 40 MHz. The rectangular cross section of the iris 21 in the resonator II had a given height of 20 mm and a maximum width of 40 mm. The relation of the distance $\Delta l$ (in mm) traveled by the plunger to the shift $\Delta f$ (in MHz) in the frequency is given by $$\Delta l \simeq \Delta f / 40$$

For comparison purposes, the ceramic was also heated after making the plunger control (1) without controlling the iris.

Figure 12:
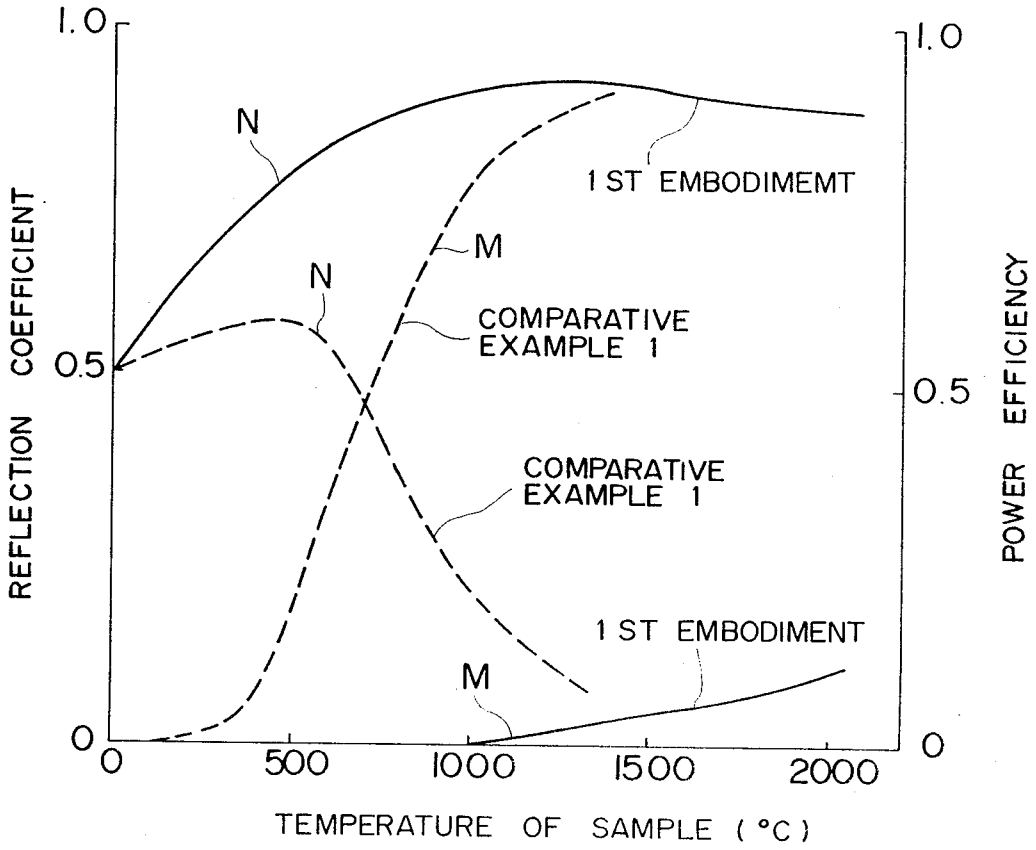

The results of the experiments were shown in FIG. 12, where each curve M indicates the dependence of the reflection coefficient of the resonator on the temperature of the sample, and each curve N indicates the dependence of the power efficiency of the resonator on the temperature of the sample. In comparative example 1, only the plunger was controlled. In this case, the reflection coefficient increased rapidly with temperature. Little microwave power was supplied into the cavity resonator, resulting in a low power efficiency. Hence, it was impossible to melt the rod of alumina. In the novel apparatus, the iris and the plunger were controlled. In this case, the reflection coefficient was quite low, while the power efficiency could be maintained at a maximum value. The rod of alumina could be heated up to its melting point, i.e., 2050° C. In this way, the novel apparatus is capable of heating the ceramic always with maximum power efficiency. Consequently, it can rapidly heat even ceramics having quite small dielectric loss factors up to high temperature.

A second embodiment of the apparatus shown in FIG. 1 is similar to the first embodiment shown in FIG. 10 except that the frequency of the microwave oscillator is controlled rather than the plunger. More specifically, the apparatus of this second embodiment uses none of the plunger 22, the plunger motor driver circuit 621, and the pulse motor 622 employed in the apparatus shown in FIG. 10. The frequency of the microwave oscillator 10 is controlled by the frequency setting circuit 611. This second embodiment belongs to the first, second, fourth and sixth modes of the first aspect of the invention.

Figure 13:
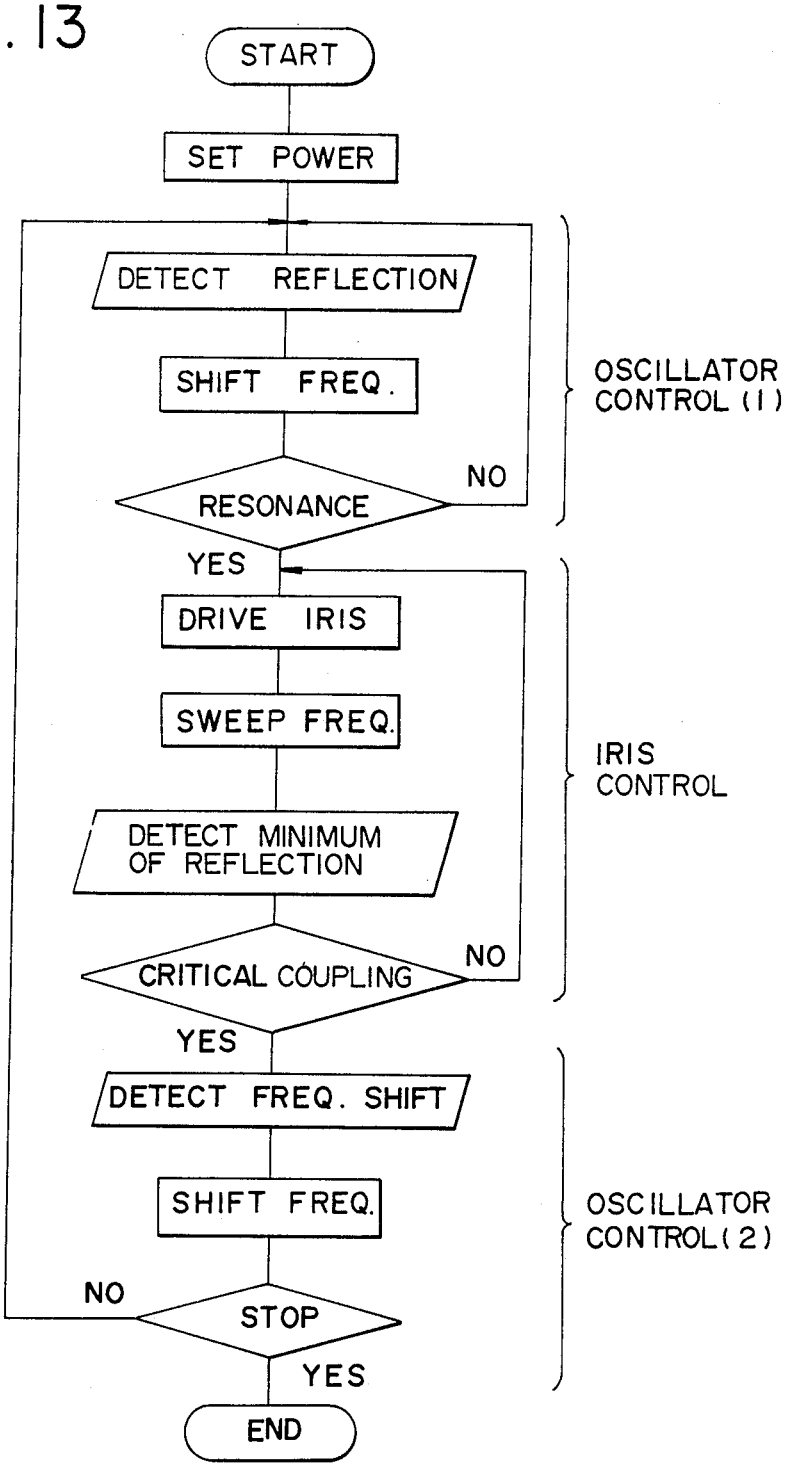

The variable iris 21 in the cavity resonator II and the frequency of the microwave oscillator are controlled as illustrated in the flowchart of FIG. 13. The apparatus functions similarly to the apparatus shown in FIG. 10 except that the frequency of the microwave oscillator is controlled rather than the plunger. First, certain microwave power is caused to enter the cavity resonator II to heat the ceramic placed within it. As the ceramic is heated, the resonant frequency and the degree of coupling of the resonator II are varied. The frequency of the oscillator is controlled (1) according to the shift in the resonant frequency. The frequency of the microwave oscillator 10 is thus shifted to bring the resonator II into resonance. Then, the iris is controlled to bring the degree of coupling to unity, in the same way as in the previous example. Thereafter, the frequency of the oscillator is controlled (2) to detect the amount of change in the resonant frequency caused by the iris control. The frequency of the oscillator is shifted to bring the resonator II into resonance again. These operations are repeated to bring the resonator II substantially into resonance and the degree of coupling to exactly or nearly unity.

In the oscillator control (1), the frequency of the oscillator is varied by a predetermined frequency. The reflection coefficient obtained after the frequency shift is compared with the coefficient obtained before the shift. When the reflection coefficient has decreased after the shift, the frequency of the oscillator is again shifted by the predetermined frequency in the same direction. When the coefficient has increased after the shift, the frequency of the oscillator is shifted by the predetermined frequency in the reverse direction. In this way, the frequency of the oscillator is controlled in a stepwise fashion until the coefficient is reduced to a minimum.

In the oscillator control (2), the amount of change in the resonant frequency caused by the sweeping of the frequency in the previous iris control is detected. The frequency of the oscillator is shifted by the amount of change in the resonant frequency. The oscillator control (2) can make use of the same steps as the oscillator control (1). It is also possible to omit the oscillator control (2) and to alternately and repeatedly make the oscillator control (1) and the iris control. However, the oscillator control (2) allows a reduction in the range over which the frequency is swept during the iris control. Further, the reflection coefficient of the resonator II varies less. The frequency setting circuit 611 shown in FIG. 10 is used for the sweeping of the frequency to control the iris and also for the adjustment of the frequency to control the frequency of the oscillator.

This apparatus was employed to heat a rod of alumina in the same manner as the first embodiment described above. This embodiment yielded the same advantages as the previous embodiment. In addition, a higher control velocity could be achieved, because the frequency of the oscillator was controlled with a higher response than the control of the plunger.

Figure 14:
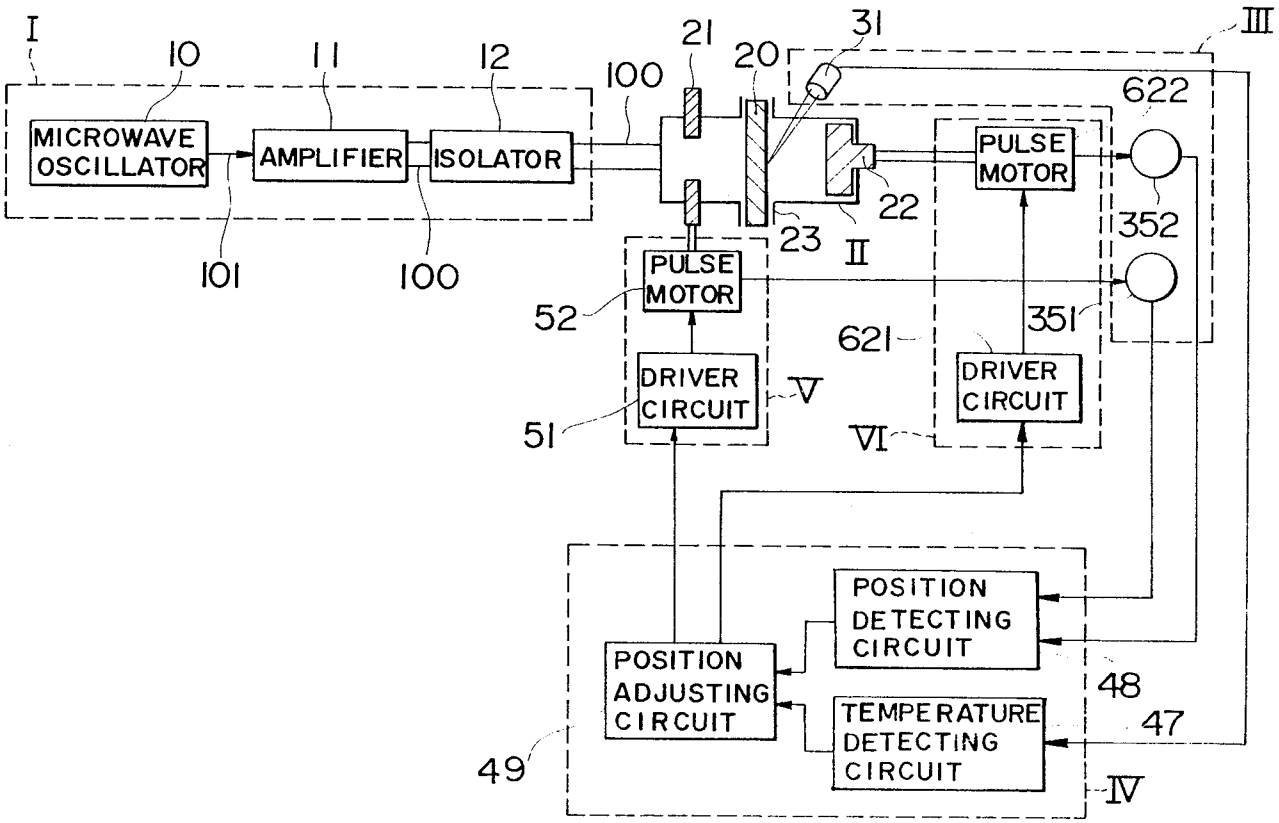

Referring to FIG. 14, there is shown a third embodiment of the apparatus shown in FIG. 1. In this embodiment, the temperature of the ceramic placed inside the cavity resonator is detected. The iris in the resonator and the plunger are controlled simultaneously to bring the resonator during the heating substantially into resonance and the degree of coupling to exactly or nearly unity. This third embodiment belongs to the third mode of the first aspect of the invention.

The apparatus shown in FIG. 14 comprises the microwave generator portion I for producing microwave power, the cavity resonator II for heating a sample, the detector portion III for detecting the temperature of the sample and the state of the resonator II, the control portion IV for delivering signals to adjust the degree of coupling and the resonant frequency of the resonator II according to one output signal from the detector portion III, the iris control portion V for varying the opening area of the variable iris 21 formed in the resonator II to adjust the degree of coupling according to one output signal from the control portion IV, and the frequency control portion VI for adjusting the resonant frequency of the resonator II according to the other output signal from the control portion IV.

The microwave generator portion I comprises the microwave oscillator 10, the amplifier 11, and the isolator 12 for absorbing the power reflected from the resonator II. The oscillator 10 is connected to the amplifier 11 by the coaxial cable 101. The amplifier 11 is connected to the isolator 12 by the waveguide 100. The cavity resonator II has the iris 21 and the plunger 22. The resonator is also provided with the port 23 through which a sample is inserted.

The detector portion III comprises a radiation thermometer 31 for measuring the temperature of the ceramic 20 placed in the resonator II, a potentiometer 351 for detecting the position of the iris 21 in the resonator II, and another potentiometer 352 for detecting the position of the plunger 22.

The control portion IV comprises a temperature detecting circuit 47 for detecting the output signal from the radiation thermometer 31, a position detecting circuit 48 that arithmetically treats the output signals from the potentiometers 351, 352 to detect the positions of the iris and the plunger, and a position adjusting circuit 49 for calculating the distances traveled by the iris 21 and the plunger 22 in the resonator II and converting them into pulse signals.

The iris control portion V comprises a pulse motor 52 for varying the opening area of the iris 21 in the resonator II and an iris motor driver circuit 51 for driving the pulse motor 52 according to one output signal from the control portion IV.

The frequency control portion VI comprises a pulse motor 622 for driving the plunger 22 in the resonator II and a plunger motor driver circuit 621 for driving the pulse motor 622 according to the other output signal from the control portion IV.

In the operation of the apparatus shown in FIG. 14, the microwave oscillator 10 produces microwave power which is amplified by the amplifier 11. The output signal from the amplifier 11 is fed to the resonator II through the isolator 12. The temperature of the ceramic 20 placed within the resonator II is detected by the radiation thermometer 31. The output signal from the thermometer 31 is applied to the temperature detecting circuit 47, which corrects the detected temperature to compensate for the decreases in the emissivity of the surface of the ceramic 20 that are caused by the varying temperature. The detecting circuit 47 delivers an output signal of a certain level to the position adjusting circuit 49. The output signal from the potentiometer 351 that indicates the position of the iris is fed to the position detecting circuit 48. The output signal from the potentiometer 352 which indicates the position of the plunger is also supplied to the position detecting circuit 48. These output signals are converted into signals of a certain level. The output signal from the position detecting circuit 48 is fed to the position adjusting circuit 49 which calculates the distances traveled by the iris and the plunger from the signals delivered from the temperature detecting circuit 47 and from the signal delivered from the position detecting circuit 48, in order to bring the resonator II substantially into resonance and the degree of coupling to exactly or nearly unity. The calculated distances are converted into pulse signals that are fed to the iris motor driver circuit 51 and to the plunger motor driver circuit 621. These driver circuits 51 and 621 produce signals for controlling the iris and the plunger, respectively. These control signals are supplied to the pulse motors 52 and 622, respectively, to drive the iris 21 and the plunger 22 at the same time.'

The position adjusting circuit 49 performs arithmetic operations in the manner described below. When a ceramic is heated, its specific dielectric constant and dielectric loss factor vary. There is a certain relation between the specific dielectric constant and the distance traveled by the plunger. Also, a given relationship exists between the dielectric loss factor and the distance traveled by the iris. Therefore, it is possible to determine the distances traveled by the plunger and the iris at each temperature by finding the specific dielectric constant and the dielectric loss factor at each temperature. In this way, the ceramic can be effectively heated while the resonator II substantially resonates and the degree of coupling is exactly or nearly unity.

The same alumina rod as the rod used in the first embodiment shown in FIG. 10 was heated as a sample, using the apparatus shown in FIG. 14. The diameter of the rod was 3 mm. Under the condition that the degree of coupling was unity, the dependence of the plunger position in the resonator on the temperature of the sample was measured. Also, the dependence of the iris width in the resonator on the temperature of the sample was measured. These relations are shown in FIG. 15, where the solid line indicates the dependence of the plunger position on the temperature of the sample and the broken line indicates the dependence of the iris width on the temperature of the sample.

Figure 15:
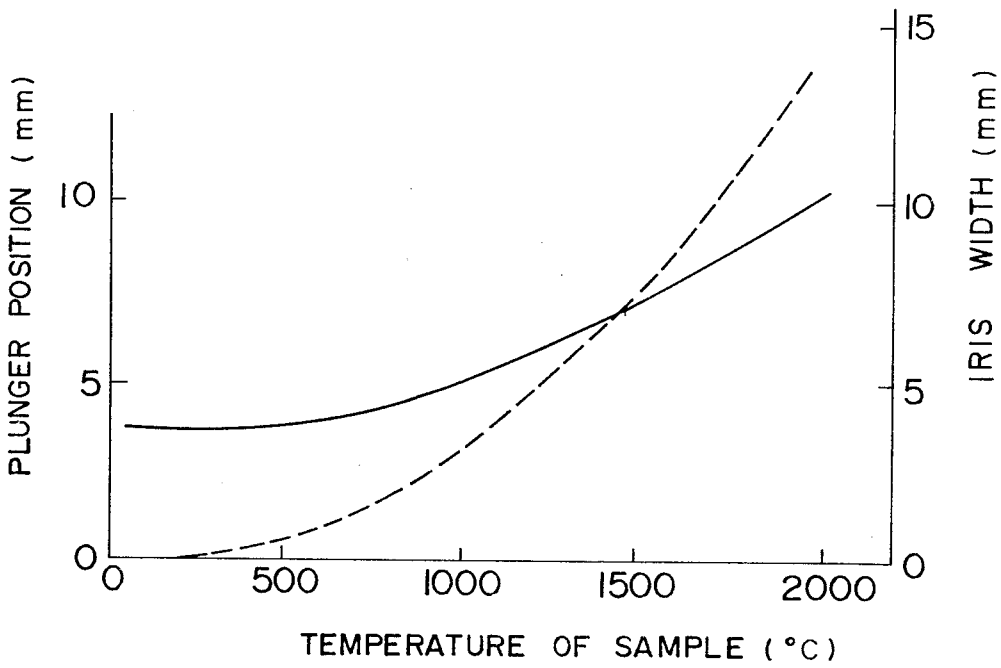

In FIG. 15, the iris width increases with increasing the width of the iris. The plunger position increases with decreasing the length of the cavity resonator. The origin indicates the condition prior to the insertion of the sample. As can be seen from the graph of FIG. 15, the iris width and the plunger position increase as the temperature of the sample increases, because the heating of the sample increases the specific dielectric constant and the dielectric loss factor of the sample.

The above relations were stored in the position adjusting circuit 49, and the sample was heated. Thus, in this example, the iris and the plunger can be controlled simultaneously. Hence, the heating can be controlled more rapidly than in the first and second embodiments shown in FIGS. 10 and 13. Consequently, rapid heating can be done with greater ease.

Also in this third embodiment shown in FIG. 14, it is necessary to detect neither the incident power nor the reflected power and so no reflection detector is needed. Further, it is unnecessary to sweep the frequency. This permits the use of an oscillator of a fixed frequency. Furthermore, no computer control is necessitated, since the positions of the iris and the plunger are controlled directly according to the temperature of the sample by hardware.

Figure 16:
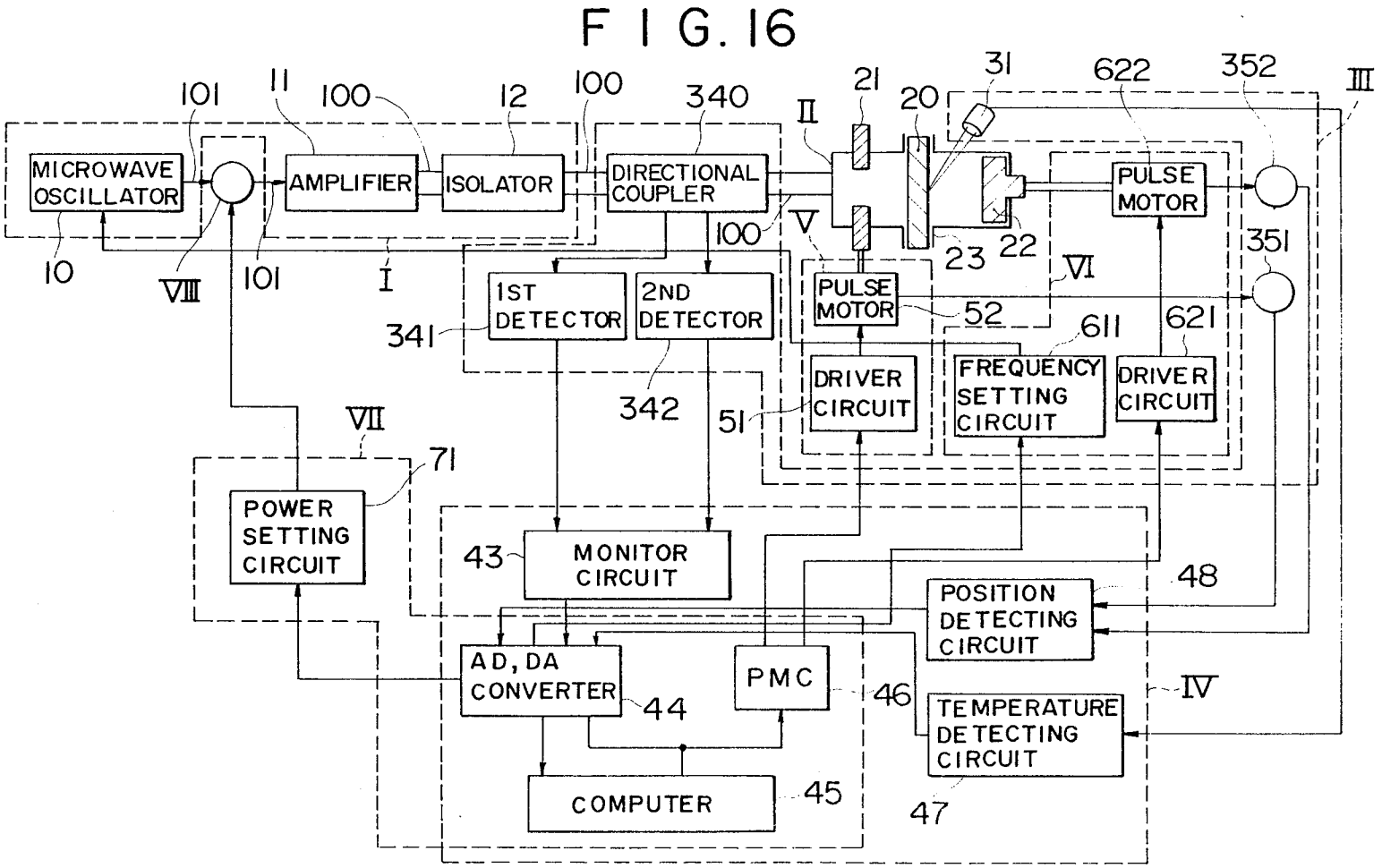

Referring next to FIG. 16, there is shown a fourth embodiment of the apparatus shown in FIG. 9. In this embodiment, the microwave power of the microwave generator portion is controlled according to the thermal loss and the dielectric loss factor and the reflection coefficient of the resonator while the heated resonator is substantially in resonance and the degree of coupling is exactly or nearly unity. The ceramic is heated at any desired rate.

The apparatus shown in FIG. 16 comprises the microwave generator portion I for producing microwave power, the cavity resonator II for heating a sample, the detector portion III for detecting the incident power to the resonator II, the power reflected from it, the temperature of the sample, and the resonance of the resonator, the first control portion IV for delivering signals to adjust the degree of coupling and the resonant frequency of the resonator II, the iris control portion V for adjusting the area of the opening of the variable iris 21 formed in the resonator II according to the output signal from the first control portion IV to adjust the degree of coupling, the frequency control portion VI for adjusting the resonant frequency of the resonator according to the other output signal from the first control portion IV, the second control portion VII for delivering a signal to adjust the power of microwaves, and the microwave power control portion VIII for adjusting the power of microwaves according to the output signal from the second control portion VII.

The microwave generator portion I comprises a microwave oscillator 10, an amplifier 11, and an isolator 12 for absorbing the power reflected from the resonator II. The oscillator 10 is connected to the amplifier 11 via a coaxial cable 101. The amplifier 11 is connected to the isolator 12 by the waveguide 100. The resonator II has the iris 21 and a plunger 22. The resonator is also provided with a hole 23 through which a sample is inserted.

The detecting portion III comprises a directional coupler 340 for separating the incident power to the resonator II from the reflected power, a first detector 341 for converting the power applied to the resonator into a low-frequency signal, a second detector 342 for converting the power reflected from the resonator into a low-frequency signal, a radiation thermometer 31 for measuring the temperature of the ceramic 20, a potentiometer 351 for detecting the position of the iris 21 in the resonator II, and a potentiometer 352 for detecting the position of the plunger 22 in the resonator.

The first control portion IV comprises a temperature detecting circuit 47 for detecting the output signals from the radiation thermometer 31, a position detecting circuit 48 that detects the output signals from the potentiometers 351, 352, a detector signal monitor circuit 43 for detecting the output signals from the detectors 341, 342, a computer 45 for treating the output signals from the temperature detecting circuit 47, the position detecting circuit 48, and the detector signal monitor circuit 43, performing arithmetic operations, and producing instruction signals, an AD,DA converter 44 for producing output signals to an power setting circuit 71 included in the second control portion VII and to the computer 45 according to the output signals from the temperature detecting circuit 47, the position detecting circuit 48, and the monitor circuit 43, and a pulse motor controller (PMC) 46.

The iris control portion V comprises a pulse motor 52 for varying the area of the opening of the iris 21 and an iris motor driver circuit 51 for driving the motor 52 according to one output signal from the first control portion IV.

The frequency control portion VI comprises a pulse motor 622 for driving the plunger 22, a plunger motor driver circuit 621 for driving the motor 622 according to one output signal from the first control portion IV, and a frequency setting circuit 611 for sweeping the frequency of the microwave oscillator 10 according to the other output signal from the first control portion IV.

The second control portion VII comprises the computer 45, the AD,DA converter 44, the pulse motor controller 46, and the power setting circuit 71. The computer 45, the converter 44, and the PMC 46 are also included in the first control portion IV. The power setting circuit 71 produces a signal for adjusting the power of microwaves according to its input signal which is supplied from the computer 45 via the converter 44.

The microwave power control portion VIII is located between the microwave oscillator 10 and the amplifier 11 and acts to adjust the microwave power according to the output signal from the power setting circuit 71.

Figure 17:
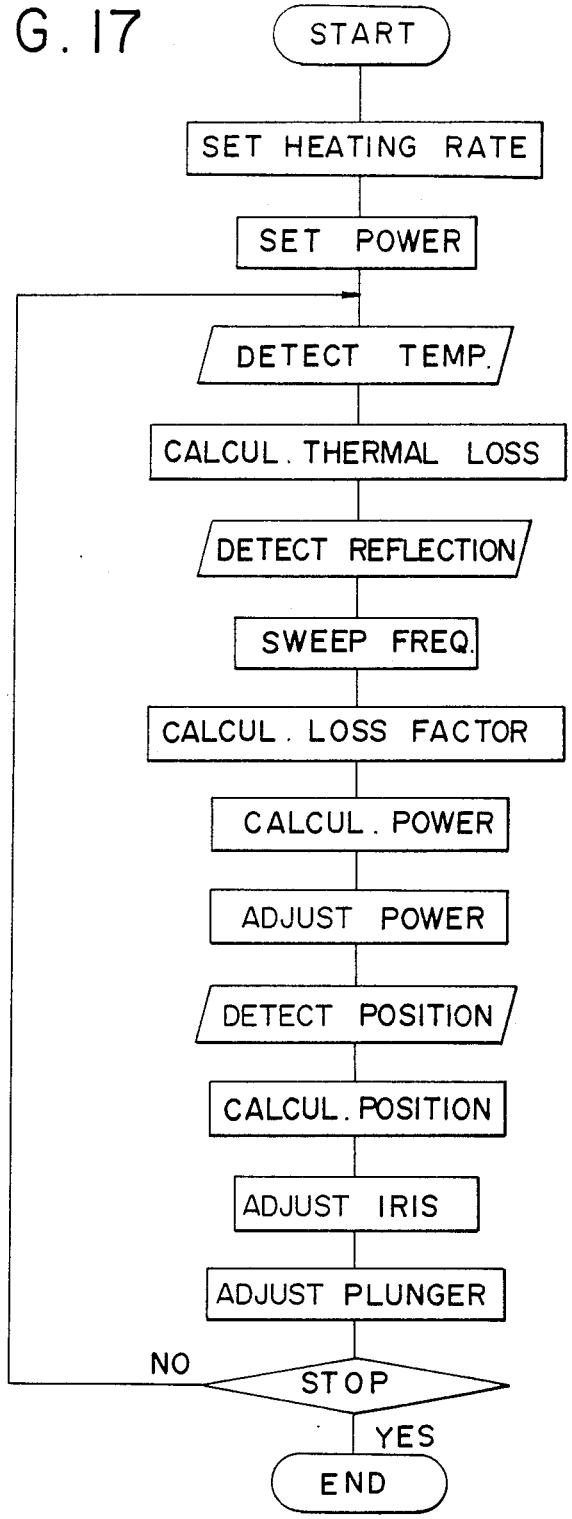

The computer 45 is programmed as illustrated in the flowchart of FIG. 17. The iris 21, the plunger 22, and the microwave power is controlled by this computer 45. First, the heating rate at which the ceramic is heated is set. Certain microwave power is produced to heat the ceramic 20 placed within the resonator H. Then, the temperature of the ceramic is detected. Data regarding the shape of the ceramic 20, the physical properties, and the heating velocity has been previously stored in the computer. This computer calculates the thermal loss of the ceramic caused by radiation, conduction, natural convection, etc. from the detected temperature and from the stored data. Then, the reflection coefficient is detected. Thereafter, the frequency is swept to calculate the dielectric loss factor at this time. The dielectric loss factor can be found by the ordinary method of measuring Q factor. The microwave power relative to the heating velocity that has been set is calculated from the computed thermal loss and dielectric loss factor and from the detected reflection coefficient. Thus, the optimum microwave power can be obtained.

Subsequently, the distances traveled by the iris and the plunger are calculated from the temperature of the ceramic. Then, the iris 21 and the plunger 22 are moved so that the cavity resonator II may substantially resonate and that the degree of coupling may become exactly or nearly unity.

These operations are repeated until a predetermined heating process of a given pattern ends. In this way, the reflection coefficient during the heating is reduced, and the power efficiency is maintained at a maximum value. That is, in this apparatus shown in FIG. 16, the microwave power is controlled according to the dielectric loss factor of the ceramic, the thermal loss, and the reflection coefficient of the ceramic. The dielectric loss factor and the thermal loss change sharply as the temperature rises. The reflection coefficient varies slightly during the heating. Consequently, the temperature can be stably and accurately controlled.

Also, the dielectric loss factor may be calculated directly from the temperature of the ceramic without sweeping the frequency. In this case, the dependence of the dielectric loss factor of the ceramic on temperature has been previously found. Further, the iris and the plunger may be controlled in the same manner as in the first and third examples already described.

In the operation of the apparatus shown in FIG. 16, the microwave power is adjusted by the power control portion VIII and fed to the amplifier 11 whose gain is kept constant. The amount of adjustment made by the power control portion VIII is controlled. The incident power to the cavity resonator II is partially separated from the reflected power by the directional coupler 340 that is connected with the first detector 341 and with the second detector 342. The first detector 341 produces a low-frequency signal proportional to the incident power. The second detector 342 produces a low-frequency signal proportional to the reflected power. The output signals from the detectors 341 and 342 are fed to the detector signal monitor circuit 43. The temperature of the ceramic 20 placed inside the resonator II is detected by the radiation thermometer 31. The output signal from this thermometer 31 is applied to the temperature detecting circuit 47. The output signals from the potentiometers 351 and 352 which are used to control the positions of the iris and the plunger, respectively, are furnished to the position-detecting circuit 48.

The output signals from the monitor circuit 43, the temperature detecting circuit 47, and the position detecting circuit 48 assume certain levels and are applied to the computer 45 via the AD,DA converter 44. The computer 45 performs arithmetic operations and issues instruction signals. That is, the computer 45 delivers output signals to the motor driver circuits 51, 621, the frequency setting circuit 611, and the power setting circuit 71.

The pulse motors 52 and 622 drive the iris 21 and the plunger 22, respectively, according to the output signals from the motor driver circuits 51 and 621, respectively, to adjust the positions of the iris and the plunger. The output signal from the frequency setting circuit 611 is fed to the microwave oscillator 10 to sweep the frequency. The output signal from the power setting circuit 71 is applied to the power control portion VIII to control the microwave power.

The same rod of alumina as used in the first embodiment shown in FIG. 10 was heated as a sample, using the apparatus shown in FIG. 16. The diameter of the rod was 3 mm. The frequency of the microwave oscillator 10 was 6 GHz. In comparative example 2, the distances traveled by the iris and the plunger were controlled under the power of about 200 W. In comparative example 3, only the microwave power was controlled. These results are shown in FIG. 18.

Figure 18:
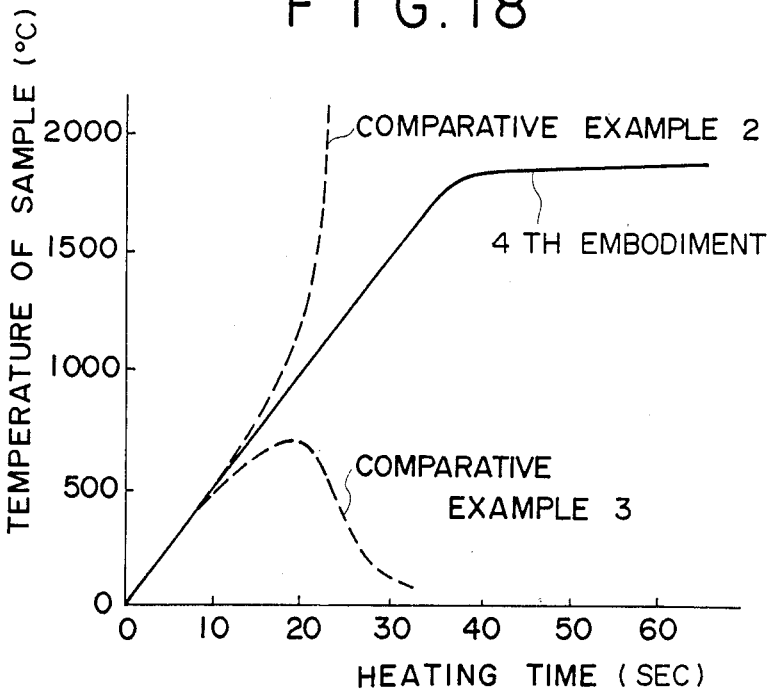
Figure 19:
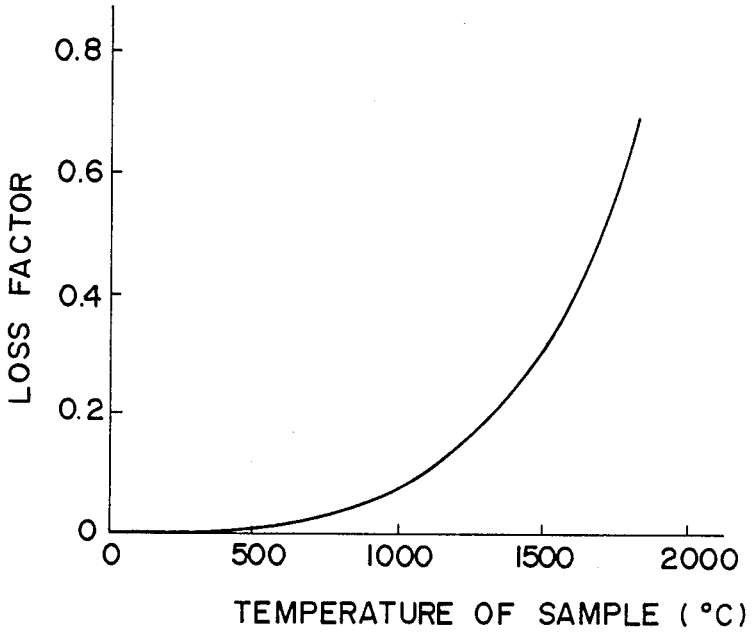

Referring to FIG. 18, in comparative example 2, the sample was heated while the distances traveled by the iris and the plunger were controlled (no power control). At temperatures exceeding 1000° C., the rod of alumina was momentarily heated very nonuniformly. This is explained by a so-called runaway phenomenon. That is, as shown in FIG. 19, as the temperature of the heated sample increases, the dielectric loss factor increases rapidly, which in turn causes sharp increases in the dielectric loss factor. As a result, the temperature of the sample is elevated rapidly. In comparative example 3, the ceramic was heated while only the microwave power was controlled. Increasing the power did not elevate the temperature of the ceramic, because as the temperature of the sample was increased, the degree of coupling and the resonant frequency of the resonator varied, greatly lowering the power efficiency.

In the fourth embodiment shown in FIG. 16, the rod was heated while the microwave power and the distances traveled by the iris and the plunger were controlled. In this case, the rod could be heated at any desired velocity, but its temperature did not exceed a predetermined value. Hence, the sample could be heated quite stably. In addition, the sample could be heated efficiently without the need of a high power, because at high temperatures exceeding 1500° C., the reflection coefficient and the power could be held within 0.2 and 100 W, respectively. Further, the temperature error caused during this process could be held below ±5° C.

In this fourth embodiment, use is made of computer control. In a modified example, the dependence of the thermal loss of the ceramic on temperature and the dependence of the dielectric loss factor on temperature are known previously. The power of microwaves and the distances traveled by the iris and the plunger are controlled at the same time by hardware according to the temperature of the heated sample and the reflection coefficient. In this fourth sample, an alumina rod having a diameter of 3 mm and a purity of 99% was employed. The apparatus shown in FIG. 16 is capable of rapidly and stably heating other oxide ceramics, such as zirconia, sialon, cordierite, steatite, and forsterite of purity less than 100% regardless of the shape of the sample.

In a fifth embodiment of the apparatus shown in FIG. 9, a preheated ceramic is heated using the apparatus shown in FIG. 16. Generally, when a ceramic having a quite small dielectric loss factor, i.e., $\epsilon_r \tan \delta$ is less than 0.001 at room temperature, is heated, a large power of microwaves is needed, because the dielectric loss factor increases only slightly from room temperature to the vicinities of 500° C. Therefore, the ceramic is heated with a poor efficiency. In this fifth embodiment, the ceramic was preheated to 500° C., using an air heater. Specifically, a rod of alumina was placed in the cavity resonator in the same way as in the first example. The front end of the nozzle of the heater was placed close to the surface of the ceramic and heated. When the temperature of the ceramic reached approximately 500° C., the air heater was taken out of the resonator. Then, the power of microwaves was controlled and the ceramic was heated, using the same heating apparatus as used in the fourth example. The nozzle of the air heater was made of a tube of quartz to prevent disturbance of the electric field within the resonator. In this example, even substances having quite small dielectric loss factors, such as sapphire, i.e., $\epsilon_r \tan \delta < 0.001$ at room temperature, could be heated up to their melting points.

In a sixth embodiment of the apparatus shown in FIG. 9, silicon nitride was used as a ceramic sample. This sample was heated within atmosphere of nitrogen to prevent the sample of silicon nitride from oxidizing. First, the ceramic sample was inserted in the apparatus used in the fourth embodiment. Then, an airtight waveguide was mounted in front of the cavity resonator. Gaseous nitrogen was admitted into the resonator through the waveguide. The gas was permitted to flow out of the resonator through a sample insertion port. In order to secure airtightness, gasket was squeezed into the locations of interconnections. Thus, air could not flow into the resonator.

A rod of silicon nitride whose $\epsilon_r \tan \delta$ is equal to 0.005 at room temperature was heated as a ceramic sample with the apparatus shown in FIG. 16. The diameter of the sample was 3 mm. The sample could be heated in the same manner as in the fourth example without oxidizing the surface of the sample. It could be rapidly heated above 1500° C. Also in this embodiment, a non-oxidizing ceramic except silicon nitride, such as silicon carbide, could be stably and rapidly heated without the surface being oxidized.

In a seventh embodiment of the apparatus shown in FIG. 9, a ceramic sample was heated while rotated to prevent nonuniform heating. First, a sample made of nonuniform alumina and having a chuck portion was inserted into the apparatus used in the fourth example. The sample was rotated at a cycle of 20 to 200 rpm by a control motor about the chuck portion and heated. Although the material of the sample was nonuniform, it could be heated stably up to the melting point of 2050° C.

In the above embodiments, ceramics having quite small dielectric loss factors less than 0.01 were heated. Obviously, the novel apparatus can be used to heat ceramics having large dielectric loss factors.

What is claimed is:

1. An apparatus for microwave heating of a ceramic comprising:

a cavity resonator in which the ceramic is placed and heated, said resonator having a variable iris for introducing microwave power;

a microwave generator portio for directing microwave power into the resonator;

a detector portion for detecting the heating state of the ceramic placed in the resonator;

a control portion comprising a controller including a control circuit, a coupling adjusting circuit, and a frequency adjusting circuit, said control circuit generating reflection coefficient signals obtained by the detected heating state of the ceramic, said coupling adjusting circuit generating an opening area signal to approach the reflection coefficient to zero based on the reflection coefficient signal in response to the variation of temperature of said heated ceramic, in view of the shift in the reflection coefficient at the frequency of the oscillator caused by controlling the frequency by said frequency adjusting circuit, and said frequency adjusting circuit generating a resonant frequency signal to approach the frequency of said resonator to the resonance based on said reflection coefficient signal in response to the variation of temperature of said heated ceramic, in view of the shift in the resonant frequency of the resonator caused by controlling the opening area of the iris by said coupling adjusting circuit;

an iris control portion for adjusting the area of opening of the iris in the resonator according to one of said signals from the control portion; and a frequency control portion for adjusting the resonant frequency of the resonator according to another one of said signals from the control portion.

2. An apparatus according to claim 1, wherein said coupling adjusting circuit further comprises a sweep circuit for sweeping the frequency of said microwave generator, for detecting the reflection coefficient of the resonator and for deciding the opening area signal based on the detected reflection coefficient thereof.

3. An apparatus according to claim 1, wherein said control portion comprises control means for delivering alternately the signal for adjusting the area of the opening of the iris in the resonator and the signal for adjusting the resonant frequency of the resonator to bring the resonator substantially into resonance and the degree of coupling to exactly or nearly unity.

4. An apparatus according to claim 1, wherein said detector portion comprises means for detecting the microwave power entering the resonator and the microwave power reflected from it.

5. An apparatus according to claim 1, wherein said detector portion comprises means for detecting the microwave power entering the resonator and the microwave power reflected from it and means for detecting the temperature of the ceramic placed in the resonator.

6. An apparatus according to claim 1, wherein said frequency control means comprises means for adjusting the microwave frequency supplied from the microwave generator portion into the resonator.

7. An apparatus according to claim 1, wherein said frequency control portion comprises means for adjusting the length of the resonator.

8. An apparatus for microwave heating of a ceramic, comprising:

a cavity resonator in which the ceramic is placed and heated, said resonator having a variable iris for introducing microwave power;

a microwave generator portion for directing microwave power into the resonator;

a detector portion for detecting the microwave power entering the resonator, the microwave power reflected from it, and the temperature of the ceramic placed in the resonator and for producing output signals according to the detection;

a first control portion for producing interrelated signals to adjust the area of the opening of the iris in the resonator and to adjust the resonant frequency of the resonator according to the output signals from the detector portion so as to cause the resonator to substantially resonate and the degree of coupling to become exactly or nearly unity;

an iris control portion for adjusting the area of the opening of the iris in the resonator according to one of said interrelated signals from the first control portion;

a frequency control portion for adjusting the resonant frequency of the resonator according to another one of said interrelated signals form the first control portion;

a second control portion which receives the output signals from the detector portion and delivers a signal for adjusting the power of the microwave generator portion to heat the ceramic at a desired heating rate according to the dielectric loss factor and the thermal loss of the ceramic and the reflection coefficient (=reflected power/incident power) at the detected temperature; and a microwave power control portion for adjusting the power of the microwave generator portion according to the output signal from the second control portion.

9. An apparatus according to claim 8, wherein said first control portion comprises a controller for generating interrelated signals of the resonant frequency of the resonator and the opening area of the iris which are decided by the heating state of the ceramic and mutual variation of the resonant frequency and the degree of coupling in controlling the resonant frequency and the opening area of the iris in order to cause the resonator to substantially resonate and the degree of coupling of the resonator to become exactly or nearly unity.

10. An apparatus according to claim 9, wherein said controller comprises a control circuit for generating first and second control signals based on the detected heating state of the ceramic, a coupling adjusting circuit for generating an opening area signal based on the first control signal, and a frequency adjusting circuit for generating a resonant frequency signal based on the second control signal.

11. An apparatus according to claim 8, wherein said first control portion comprises control means for delivering alternately the signal for adjusting the area of the opening of the iris in the resonator and the signal for adjusting the resonant frequency of the resonator to bring the resonator substantially into resonance and the degree of coupling to exactly or nearly unity.

12. An apparatus according to claim 8, wherein said first control portion comprises means for delivering the signal for adjusting the area of the opening of the iris in the resonator according to the dielectric loss factor of the ceramic at the detected temperature and also the signal for adjusting the resonant frequency of the resonator according to the specific dielectric constant of the ceramic at the detected temperature.

13. An apparatus according to claim 8, wherein said frequency control means comprises means for adjusting the microwave frequency supplied from the microwave generator portion into the resonator.

14. An apparatus according to claim 8, wherein said frequency control portion comprises means for adjusting the length of the resonator.

15. An apparatus for microwave heating of a ceramic, comprising:

a cavity resonator in which the ceramic is placed and heated, said resonator having a variable iris for introducing microwave power;

a microwave generator portion for directing microwave power into the resonator;

a detector portion for detecting the temperature, dielectric loss factor, and the specific dielectric constant of the ceramic as the heating state of the ceramic placed in the resonator;

a control portion comprising a controller including a control circuit, a coupling adjusting circuit, and a frequency adjusting circuit, said control circuit generating the dielectric loss factor signal, and the specific dielectric constant signal, obtained by the detected temperature, dielectric loss factor and the specific dielectric constant of the ceramic in said resonator, said coupling adjusting circuit generating an opening area signal decided based on said dielectric loss factor signal, in view of the shift in the reflection coefficient at the frequency of the oscillator caused by controlling the frequency by said frequency adjusting circuit, and said frequency adjusting circuit generating a resonant frequency signal decided based on said specific dielectric constant signal, in view of the shift in the resonant frequency of the resonator caused by controlling the opening area of the iris by said coupling adjusting circuit, thereby causing the resonator to substantially resonate and the degree of coupling of the resonator to become substantially unity;

an iris control portion for adjusting the area of opening of the iris in the resonator according to one of said signals from the control portion; and a frequency control portion for adjusting the resonant frequency of the resonator according to another one of said signals from the control portion.

16. An apparatus according to claim 15, wherein said detector portion comprises means for detecting the microwave power entering the resonator and the microwave power reflected from it.

17. An apparatus accrording to claim 15, wherein said frequency control means comprises means for adjusting the microwave frequency supplied from the microwave generator portion into the resonator.

18. An apparatus according to claim 15, wherein said frequency control portion comprises means for adjusting the length of the resonator.

* * * * *